United States Patent [19]

Grey

[11] Patent Number: 4,552,082

[45] Date of Patent: Nov. 12, 1985

[54] OFFSHORE INCINERATION OF HAZARDOUS WASTE MATERIALS

[76] Inventor: Vincent G. Grey, R.D. 2, Box 763A, Sussex, N.J. 07461

[21] Appl. No.: 607,606

[22] Filed: May 7, 1984

Related U.S. Application Data

[63] Continuation-in-part of Ser. No. 382,769, May 27, 1982, abandoned.

[51] Int. Cl.[4] ..... B63B 35/28

[52] U.S. Cl. ..... 114/26; 114/187; 114/270; 212/190; 110/238

[58] Field of Search ..... 250/373, 493.1; 220/1.5; 110/186, 238, 254; 166/355; 431/202; 73/54, 861; 114/26, 72, 73, 74 R, 187, 264–267, 270, 121; 212/190

[56] References Cited

U.S. PATENT DOCUMENTS

| | | | |
|---|---|---|---|
| 3,049,732 | 8/1962 | Martin | D12/215 |
| 3,362,360 | 1/1968 | Lowe | 110/238 |
| 3,401,260 | 9/1968 | Holm et al. | 73/861 |
| 3,693,557 | 9/1972 | Makuch | 110/186 |
| 3,710,614 | 1/1973 | Oppliger | 73/54 |
| 3,818,846 | 6/1974 | Reese | 110/186 |
| 3,830,177 | 8/1974 | Nemec et al. | 114/26 |
| 3,835,625 | 9/1974 | Williams | 114/187 |
| 3,854,619 | 12/1974 | Gaudy | 220/1.5 |
| 3,912,103 | 10/1975 | Gerhard | 220/1.5 |
| 3,948,196 | 4/1976 | Bleyl | 114/264 |
| 4,092,908 | 6/1978 | Straitz | 114/187 |
| 4,099,452 | 7/1978 | Costen | 114/187 |
| 4,099,667 | 3/1978 | Tyer et al. | 110/186 |
| 4,102,632 | 7/1978 | Hastings | 110/254 |
| 4,250,801 | 2/1981 | Boidron | 114/187 |
| 4,260,890 | 4/1981 | Wright et al. | 250/373 |
| 4,338,870 | 7/1982 | Lanier | 110/254 |
| 4,351,252 | 9/1982 | Shindome et al. | 110/238 |

OTHER PUBLICATIONS

Report of the Interagency Ad Hoc Work Group, (9–1980), U.S. Printing Office, 1981-335-403/7064.

The John Zink Company, Tulsa, Oklahoma, 9/1/81, *An Introduction.*

*Hazardous Waste Disposal,* John Zink Company, Tulsa, Olkahoma, 1981, paper 7710.

*Chemical Waste Incinerator Ships,* Chapman et al, Society of Naval Architects, 9/23/81.

John Zink Company Publ., (1981), "Hazardous Waste Disposal by Thermal Oxidation", pp. 1,2,8.

*Primary Examiner*—Trygve M. Blix

*Assistant Examiner*—Stephen P. Avila

*Attorney, Agent, or Firm*—Brooks Haidt Haffner & Delahunty

[57] ABSTRACT

A method and an ocean-going vessel are disclosed for more effectively incinerating hazardous liquid wastes at sea. Intermodal shipping tank containers are filled at waste generation sites; transported to dockside and loaded above decks on an incinerator ship; taken out to sea and incinerated in horizontal, liquid burning type incinerators so that the effluents emerge horizontally. Wastes flow by gravity from containers into staging sumps located below decks, and then pumped to incinerator. Pollution abatement tanks, also below decks, collect spilled waste from containers, as well as overflow from staging sumps. Material collected in abatement tanks is pumped into staging sump, and pumped to incinerator. Fuel oil may be introduced into sumps for fueling incinerators to maintain incinerator operation when there is insufficient supply of waste. Effluents are sea-water scrubbed for cooling to eliminate thermal lift and carried promptly into sea.

30 Claims, 29 Drawing Figures

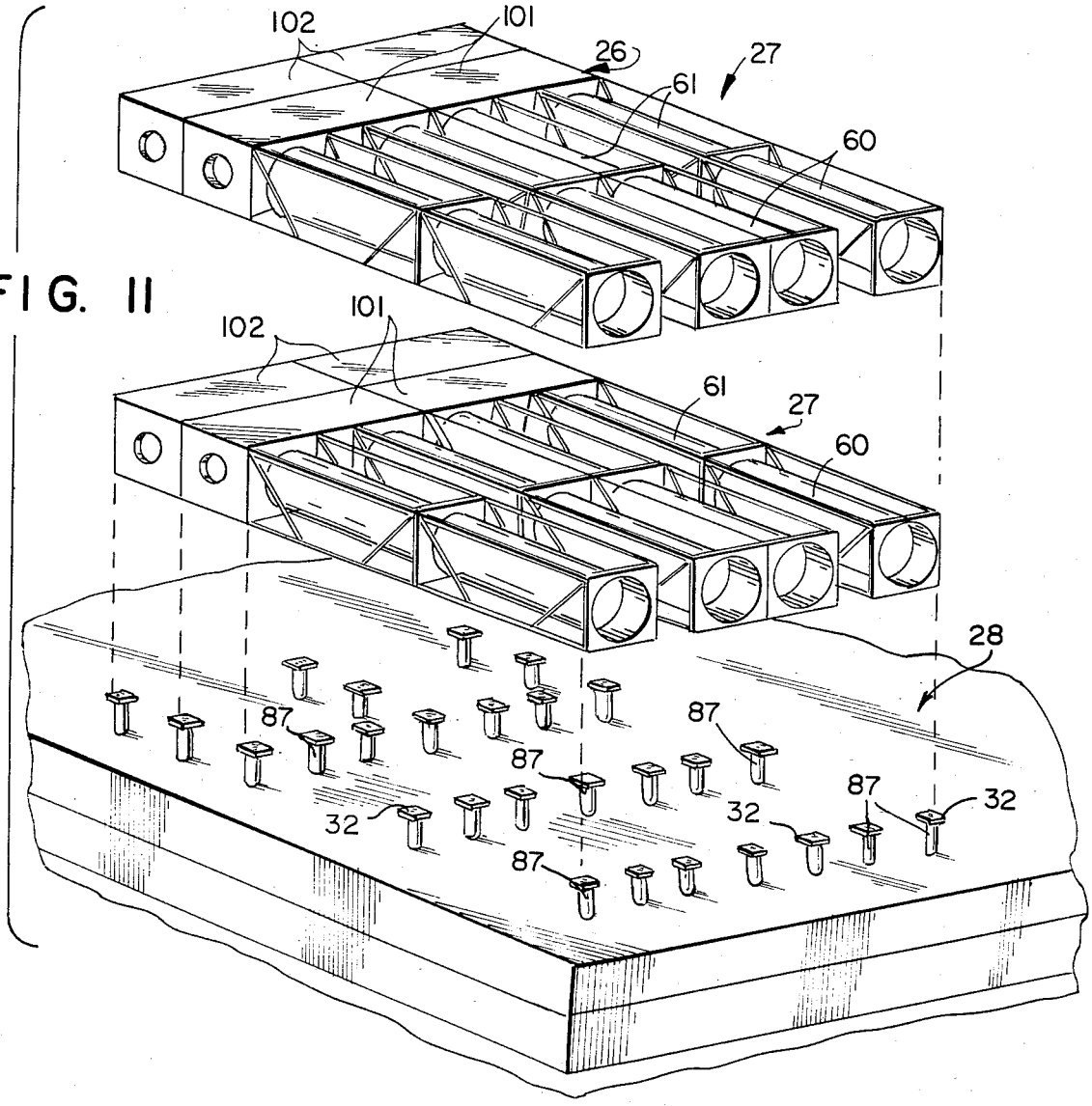
FIG. 11
FIG. 10
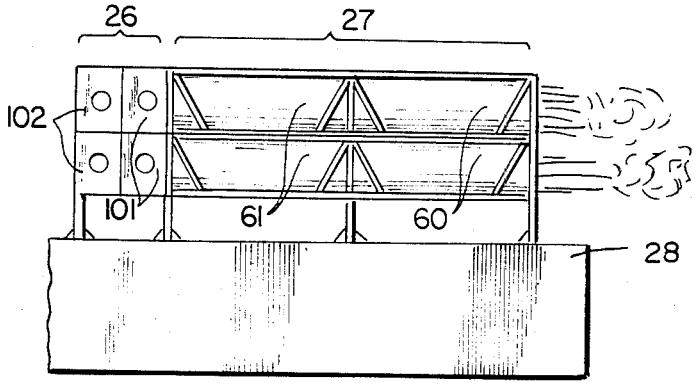

OFFSHORE INCINERATION OF HAZARDOUS WASTE MATERIALS

This application is a continuation-in-part of copending application Ser. No. 382,769, filed May 27, 1982 now abandoned.

FIELD OF THE INVENTION

This invention relates to the disposal of hazardous waste materials and, more particularly, to techniques for transporting them from the sites where they are generated, and for safely incinerating them at sea.

BACKGROUND OF THE INVENTION AND THE PRIOR ART

Although it may be useful in the disposal of solid waste materials, the invention was made in connection with attempts to more effectively dispose of liquid waste materials, and will therefore be described in connection with such use.

How to safely dispose of agricultural and industrial hazardous liquid wastes, including toxic chemicals and flammable liquids, is of increasing environmental concern. Handling of such materials is hazardous, and the cleaning up of any accidental spillage can be painstaking and expensive. When removed from the place of their generation they cannot be simply dumped at disposal sites on land or at sea without danger of seepage pollution of underground aquifers or of poisoning sea life, and their burial in containers is costly and poses similar risks. Moreover, incinerating of such wastes has caused atmospheric pollution, sometimes resulting in "acid rain" at locations far from the burnsite.

In the context of this specification, "liquid" waste material includes not only liquids which are flowable by gravity, but also pumpable sludges, and materials which are similarly flowable or pumpable upon heating. Such materials, including non-flammable materials, are known to be incineratable in incinerators having liquid fuel burners, either by feeding the material directly into the burner or upon blending it with a fuel such as diesel oil immediately before, or simultaneous with its introduction into the burner. Modern, controlled high temperature incinerators are highly efficient, and are effective to destroy 99.99 percent of such wastes. Atsea incineration is advantageous in that it removes the destruction site from populated areas.

In view of this apparent advantage of shipboard incineration, in February, 1980 a work group formed of representatives from several governmental agencies undertook a study of known incineration operations, safety and control measures, environmental impacts, waterfront facilities, and conceptual designs for incinerator ships. In September, 1980, the work group issued an initial report entitled, "Report of the Interagency Ad Hoc Work Group for the Chemical Waste Incinerator Ship Program", in which it concluded that chemical hazardous waste incineration at sea is a cost-effective, technically efficient, and environmentally acceptable manner of destroying many hazardous wastes. The work group was expanded and became known as the "Interagency Review Board for the Chemical Waste Incinerator Ship Program". It presented its findings from further studies of important ship design factors, including regulatory requirements, incinerator technologies, and the like, in September, 1981 in a report entitled, "Chemical Waste Incinerator Ships—The Interagency Program to Develop a Capability in the United States". The report includes a conceptual design for an incinerator ship that can incinerate both liquid wastes and solid wastes, and discusses waterfront facilities as may be required for such incinerator ship operations.

As mentioned in that report, several officially-sanctioned shipboard test incineration operations were successfully conducted on the incinerator ship M/T VULCANUS off the coast of the United States. This ship was especially designed for the incineration of liquid chemical waste at sea, which it carries to the offshore burnsite in 15 cargo tanks below decks. The ship was designed in accordance with the latest regulations of the International Maritime Organization (IMO) and other regulatory bodies. The cargo is loaded by pumping the material through pipelines and hoses into the ship's cargo hold from large storage tanks at the waterfront facility where the ship docks, and the liquid waste material is often blended together, either in the storage tanks or in the ship's cargo holds. The ship sails to the burnsite location many miles off shore, at which the cargo is pumped from the storage tanks into two large liquid injection incinerators having vertical stacks.

The conceptual ship design offered by the Interagency Review Board is similar to the M/T VULCANUS in that, like a tanker, the liquid waste cargo is carried in the ship's cargo tanks, or built-in tanks below decks, and is pumped to any of three (instead of two) similar liquid injection incinerators having vertical stacks. However, the conceptual design also provides for the carrying of solid hazardous wastes in containers which are initially stored on deck, and which are transported via a transporter cart to a rotary kiln incinerator into which the solid waste from the containers is dumped and incinerated. The products of incineration from the rotary kiln are fed into one of the liquid injection incinerators.

OBJECTS OF THE INVENTION

Even these modern techniques for disposing of hazardous waste by incineration at sea continue to have disadvantages. For example, the thermal lift from the vertical shipboard incinerators carries the effluent gases high up into the atmosphere, and may be carried by winds many miles to regions over land or over sea lanes at which they may combine with moisture and fall as harmful "acid rain". Although the Interagency Review Board recognizes the desirability of "scrubbing" the effluents with water to cleanse them, the use of scrubbers on vertical stack incinerators, if possible at all, would reduce or eliminate the thermal lift of these gases, which thermal lift is necessary for proper operation of the incinerator.

Further, the blending of hazardous liquid waste cargoes, either in the land based storage tanks at the dockside or within the ship's cargo holds, may detract from the efficiency of incineration due to differences between the optimum incineration temperatures for the several different types of chemicals which are mixed. For example, if polychlorinated biphenols (PCB's) are contained in the blended waste, all of the waste must be incinerated at the highest heat level required to properly incinerate the PCB's whereas, if each waste material is burned separately, optimum temperatures of incineration, perhaps lower than that of PCB's, can be used for each. In other words, it is preferable to have uniform material fed to the incinerator, rather than to mix several cargoes whose optimum burn temperatures may be quite different from each other. In addition, separate burning of different wastes permits precise time and geographic coordinates to be identified for each waste destroyed, thereby permitting certificates of ultimate destruction to be properly issued to the person who generated the waste, as required by the Resource Conservation and Recovery Act (RCRA).

Moreover, the carrying of liquid cargo below decks presents some hazard and possible spillage upon grounding of the ship, or other hull penetration, and it is difficult to control any leakage from such cargo tanks. Of course, cargo held in tanks below decks must always be pumped because gravity flow is not possible, and the tanks and pumps are difficult to empty and clean. The same disadvantages of blending of the hazardous waste materials, and the difficulty of pumping from and cleaning the tanks are also incidental to the large storage tanks at dockside in which the waste materials are temporarily stored for loading on the incinerator ship after it returns from sea. In addition, the waste material itself must be transported from the sites where it is generated and loaded into the storage tanks, which necessitates additional handling of the hazardous waste material.

Accordingly, it is intended by the present invention to provide a method of disposing of hazardous liquid waste materials in which the materials may be transported from the sites where they are generated to the offshore incinerator site and incinerated, without the need for intermediate transfer and consequent handling of the dangerous chemical materials. In addition, the present invention contemplates that the waste materials need never be blended, but may be incinerated in the same form or composition as that in which the waste material was initially received from its generating site. Thus, its burn and other characteristics are more accurately determinable and controllable.

It is a further object of the invention to provide a means for storing the liquid waste material on board the ship which will facilitate its subsequent feeding to the incinerators, and by which spillage of any of the waste materials can be easily removed and incinerated, rather than requiring that it be discharged overboard.

Moreover, the manner of feeding the cargo to the incinerators must accommodate any desirable blending of cargo, or any desired addition of supplemental fuel oil to enhance the burning.

Further, it is intended by the present invention to provide means by which the effluent discharge from the incinerators will not be carried aloft to the atmosphere with the attendant danger of subsequent falling as acid rain.

BRIEF DESCRIPTION OF THE INVENTION

Briefly and generally describing the present invention, it provides a method for disposing of blended or unblended hazardous liquid waste materials utilizing intermodal tank shipping containers which are filled with the waste material at the respective sites at factories, etc. where they are generated; are then hauled over the road or via rail or river barge to a dockside where they are lifted on board a barge or incinerator ship; are then transported to an offshore burnsite and incinerated using a horizontal incinerator and scrubbers to direct the effluent discharge from the incinerator towards and thus into the sea in the shortest possible time so as to avoid rise of the effluents into the atmosphere. Thus, the arrangement takes advantage of the known reduction of thermal lift of the effluents when a cold water scrubber is used, as well as of the beneficial cleansing of the gases as is effected by the scrubbing itself. Periodic collection and analysis of the scrubber water residue facilitates control of the burn system, as will be seen. It will also be noted that storage tanks at the dockside are eliminated, and no transfer of the hazardous material out of their initial containers is required prior to incineration. Costly construction and maintenance of storage tank farms are avoided, and the hazards involved in waste handling are minimized.

In accordance with the invention these techniques can be practiced utilizing a self-propelled vessel having one or more horizontal incinerators thereon in addition to container guides for receiving the intermodal containers; or a barge, preferably a tug-towed barge, having both the incinerator and container guides on board, this being the preferred arrangement; or a separate incinerator barge and a plurality of barges for hauling the containers to and from the continuously operating incinerator barge on station at sea.

Thus, the present invention also provides a seagoing incinerator vessel, preferably a tug-towed barge, which carries one or more rearwardly facing and horizontally oriented incinerators or oxidizers on the weatherdeck of the vessel; container guides for carrying a number of the intermodal tank containers on and above its weatherdeck; and appropriately valved pipe conduits for selectively emptying the stacked containers by gravity flow or gravity-assisted flow, and with or without waste blending as may be desired, first to a staging sump located below the weatherdeck, and then by pumping from the staging sump to the burner of an on-board incinerator.

Because all of the containers containing the hazardous liquid wastes are stored above the main or weatherdeck, all of the containers and the hazardous waste conduits on the ship are visible for prompt detection of leakage, and are protected from damage in the event of grounding or other hull penetration. The containers can be located inboard to the extent necessary to meet international safety regulations. Moreover, the containers are more easily handled by a dockside crane and fully visible to the operator when loading or unloading them and, as previously mentioned, their storage on and above the weatherdeck takes advantage of gravity flow and reduces the need for pumping. The below decks areas of the ship are free for filling with supplies, fuel, or ballast. Such ballast may be used to trim the vessel by its stern, to angle the incinerator discharge outlets downwardly towards the sea so that the emerging effluents will contact the sea more promptly to avoid pollution of the atmosphere.

In addition, the use of intermodal shipping containers makes operation of the system relatively clean, with little likelihood of spillage and cleanup. However, should any of the containers leak or be damaged so that spillage results, by providing bulwarks, scuppers, and spillage abatement tanks as will be described, their disposition above the weatherdeck facilitates cleanup by conducting a flow of the spillage first into an abatement tank and thence into a staging sump for pumping to an incinerator, rather than necessitating pumping of the spillage overboard with resulting pollution of the waterway. As will be seen, the abatement tanks can also accommodate any overflow from a staging sump, without requiring such overflow to be discharged overboard, while the cause for such overflowing of a staging sump can be corrected.

The piping mounted on the weatherdeck of the vessel for conducting the flow of waste materials from the individual containers incorporates appropriate valving, pumps, and a cleanout loop for convenient cleaning of the lines. If desired, steam lines extend to one or more of the stacked groups of containers for introduction into one or more of the steam chambers of the respective tank containers for heating their contents to promote flow.

Flow from the containers is via risers respectively associated with each container group, and to which each container in the group is connected by flexible hose and a valve. The risers are respectively connected to a transversely extending header pipe mounted on the weatherdeck, which, in turn, leads through a shutoff valve into either of a pair of longitudinally extending header pipes mounted amidships on the weatherdeck. The longitudinal header conducts the flow to a staging sump at one of its ends. Another pair of longitudinal headers, also located amidships, services the groups of containers on the opposite side of the vessel via similar risers and transverse connecting headers.

The use of two pairs of headers, one pair servicing the rows of containers on each side of the ship, facilitates the mounting and use of four incinerators at the stern of the ship, each being fueled by waste drawn from a separate, associated staging sump, as will be seen. Thus, one or more incinerators can be dedicated to burn certain types of wastes, without affecting others.

The staging sumps also permit better control of the burn efficiencies of the respective incinerators because any desirable blending of hazardous wastes can be conducted in one staging sump without affecting the others. Similarly, if desired, diesel or other fuel can be added to any one sump to improve or maintain burning in one incinerator, without effect on any of the other incinerators. Further, as will become apparent, certain types of hazardous waste cargoes can be isolated in a given container grouping, and burned in a specially adapted incinerator or oxidizer.

Effluent discharge from each of the horizontally disposed oxidizers is directed horizontally rearward or angularly downward from the horizontal and towards the sea, so that the effluents reach and impinge upon the sea surface as promptly as possible. This downward pitch is preferably achieved by a corresponding downwardly angled shaping of the horizontal oxidizer discharge outlet itself. Alternatively or additionally, the ship may be ballasted and trimmed by its stern so that the aft-facing incinerator outlets of the incinerators will face angularly downward towards the sea.

The preferred arrangement also provides a pair of sea-water scrubbers, aligned one behind the other, adjacent to the discharge outlet of each incinerator. Each scrubber takes the form of an annular conduit, such as sprayer pipe arranged in the form of a square whose center is coincident with the centerline of the exhaust gas stream. The scrubber provides a water spray rack which directs sprays of water in all four directions inwardly and across the stream of effluents as it emerges from the incinerator outlet. The second scrubber is similar, though slightly larger in size, and is mounted about two feet aft of the first. Not only do these scrubbing sprays densify and cool the horizontally emerging hot effluent gases to virtually eliminate their thermal lift, but they saturate and dilute the emerging gases and entrap and remove particulates. Thus, samples taken from the scrubbing water residue can be analyzed and compared with the composition of the sea water used for the spray, for indication of the effectiveness of the incineration.

DETAILED DESCRIPTION OF PREFERRED EMBODIMENTS

These and other objects, features and advantages of the invention will be more readily apparent from the following detailed description of several of its embodiments. In the description, reference will be made to the accompanying drawings, in which:

FIG. 10 is a fragmentary profile view of only the stern end portion of the vessel of FIGS. 1–9 to illustrate the stacked arrangement of its incinerators;

FIG. 11 is a fragmentary exploded view in perspective of the same incinerator mounting arrangement;

Figure 1:
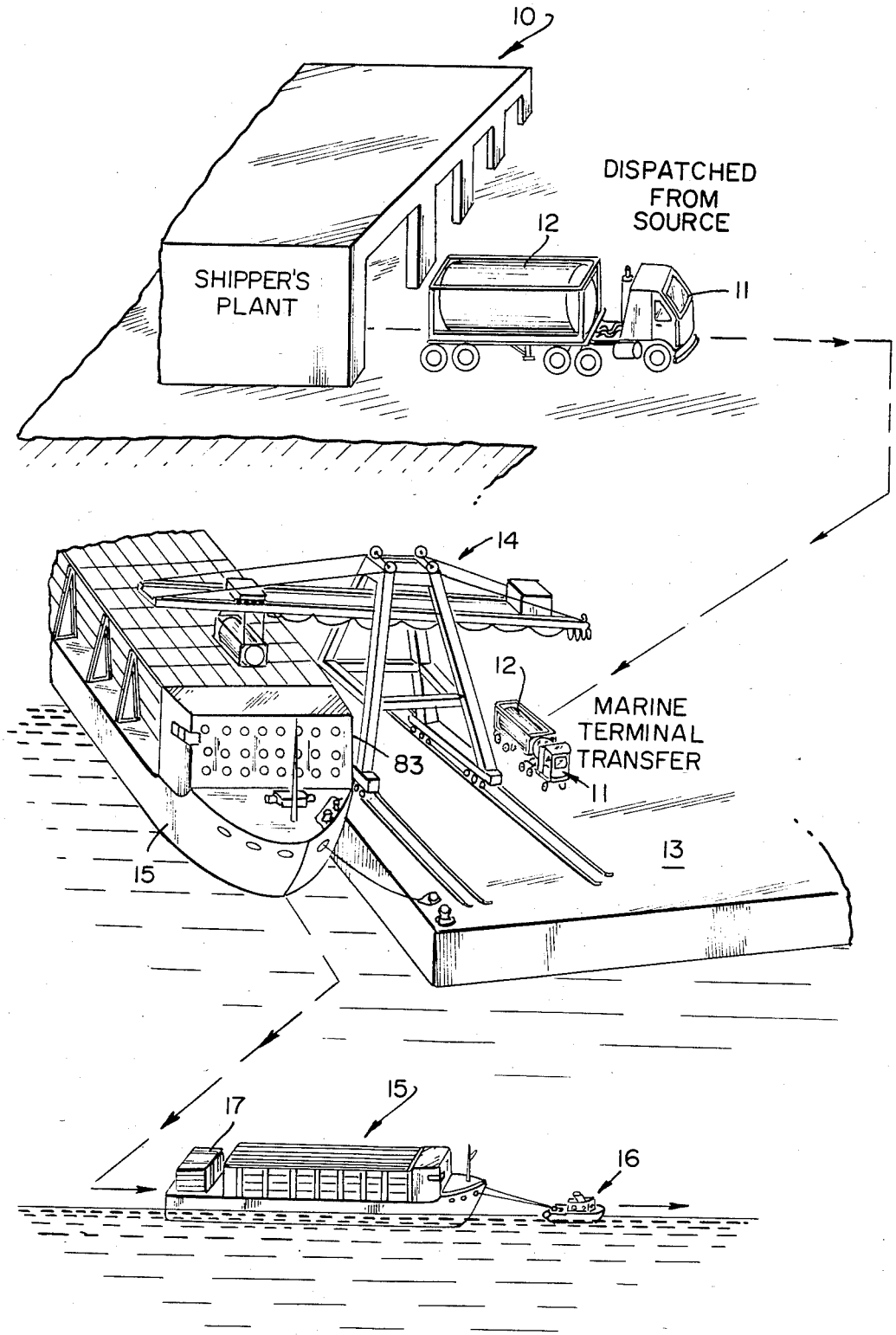
FIG. 1 is a somewhat schematic illustration of a method for disposing of hazardous liquid waste materials in accordance with the invention.
Figure 2:
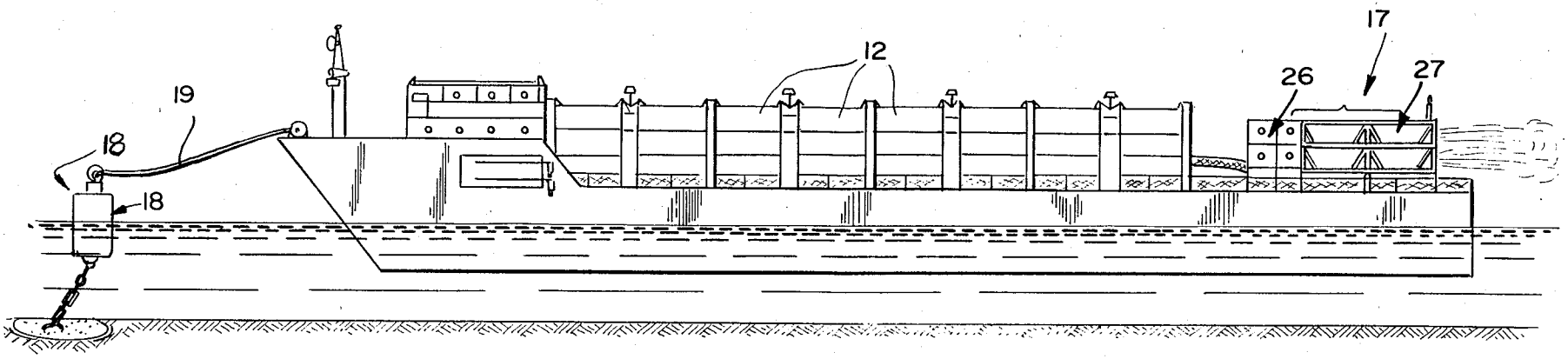
FIG. 2 is a profile view of a sea-going vessel in accordance with the invention for incinerating the hazardous liquid waste materials.
Figure 3:
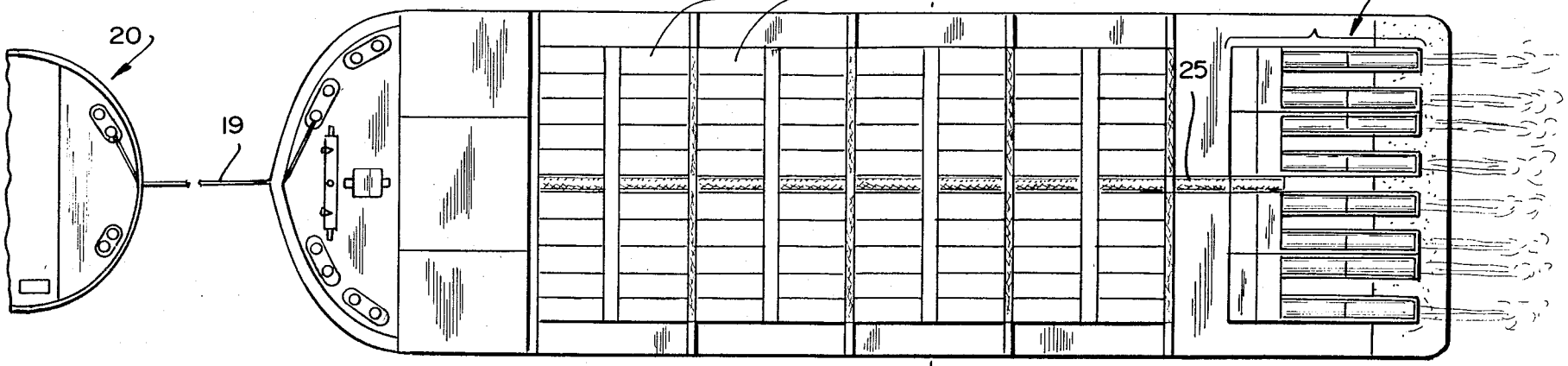
FIG. 3 is a plan view of the vessel of FIG. 2.

Referring to the drawings and in particular to FIGS. 1, 2 and 3, hazardous waste is removed from a shipper's plant 10 in an intermodal container 12 by truck 11 or by rail car (not shown) to the marine terminal 13. The tank containers will not transfer their contents at the marine terminal. Nor will the containers remain for an extended storage period. The intermodal container 12 is lifted from truck 11 by crane 14 onto the sea-going vessel 15. The sea-going vessel 15 with intermodal containers stacked in the mid section of the vessel and the incinerator 17 stacked in the stern section is pulled by tug 16 out to an incinerating station at sea. Thus the location for burning is well removed from any residential area or industrial complex.

Figure 4:
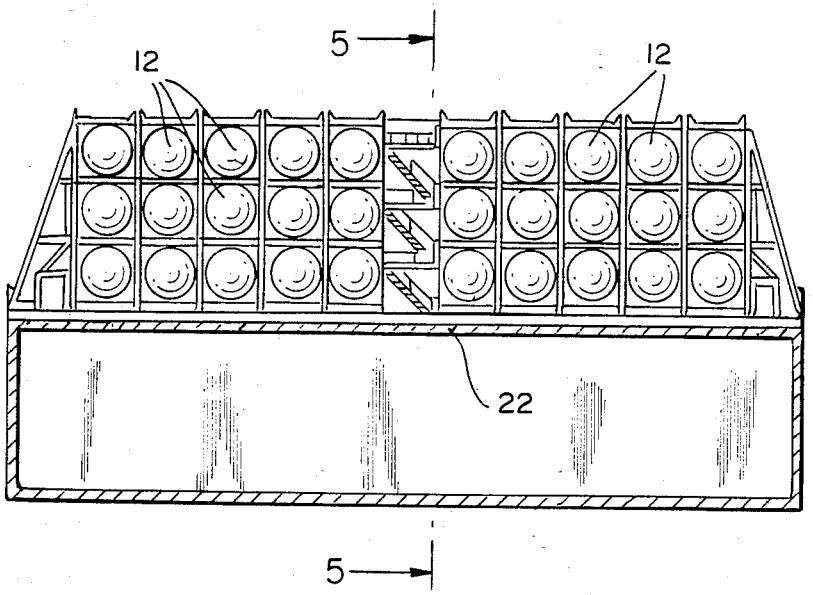
FIG. 4 is a transverse sectional view of the vessel as seen from line 4—4 in FIG. 3.
Figure 5:
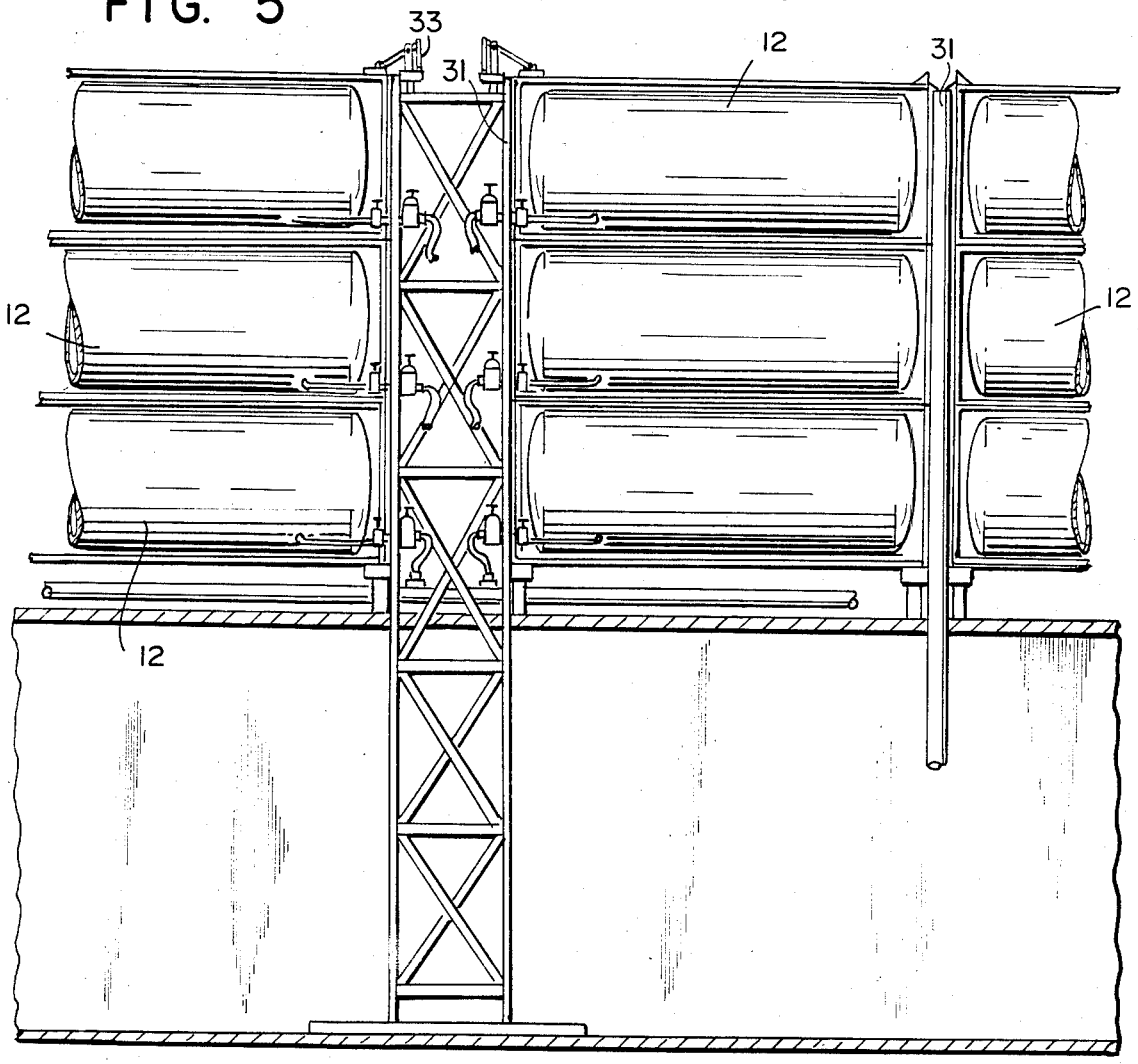
FIG. 5 is an enlarged fragmentary view of the vessel as seen from line 5—5 of FIG. 4.

Sea-going vessel 15, a powerless barge (i.e., nor self-propelled), is held in position by tether 19 having one end secured to the barge 15 and its other end secured either to buoy 18 as when it is moored at an offshore burnsite, or to a self-propelled vessel 20 as when being towed to the burnsite. The intermodal containers filled with hazardous wastes are placed in stacked rows. The stacks are each preferably 3 containers high, as most clearly illustrated in FIGS. 4 and 5.

Hazardous wastes are fed by gravity flow or pumped to the incinerators 17, to be burned therein; the effluents escaping through the incinerator oxidizers 27. Incinerators 17 in FIG. 2 are each composed of two transverse pump and burner enclosures generally indicated by numeral 26 and two transversely adjacent horizontally extending longitudinal oxidizer enclosures 27. Each oxidizer 27 may be one continuous chamber of approximately 40 feet in length as illustrated by reference numeral 216*d* in FIGS. 24 and 25, or composed of two disconnectable modular elements of 20 feet each, as indicated by numerals 60 and 61 in FIG. 20. The pump and burner enclosures 26 are shown in modular arrangement as at 102 and 101, respectively, in FIG. 20. Preferably the effluents are sprayed with sea water to reduce the tendency of the plume to rise into the air. Sea water may also be used to spray the outer walls of the incinerator and oxidizers to reduce the temperature thereof.

The tethering of the barge or barges will allow the barge to swing with the wind so that the plume is blown away from the ship and safeguard the crew.

One arrangement comprises two powerless vessels such as two barges. A more detailed description of the arrangement and the operation of the present invention will be described in connection with a two barge system, FIGS. 13 and 14.

Figure 15:
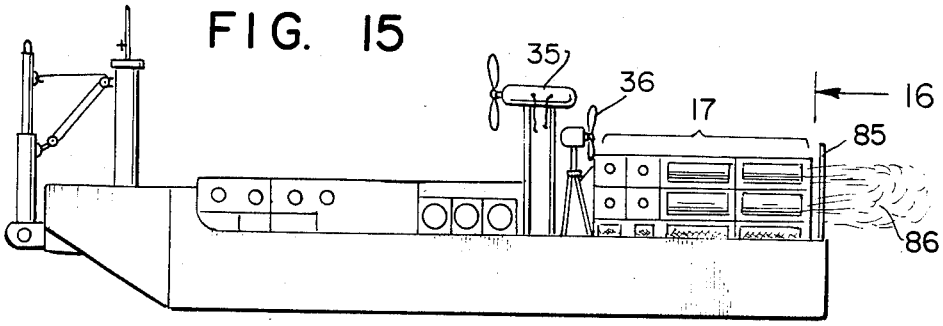
FIG. 15 is a profile view of an incinerator vessel incorporating a further modification of the invention.
Figure 16:
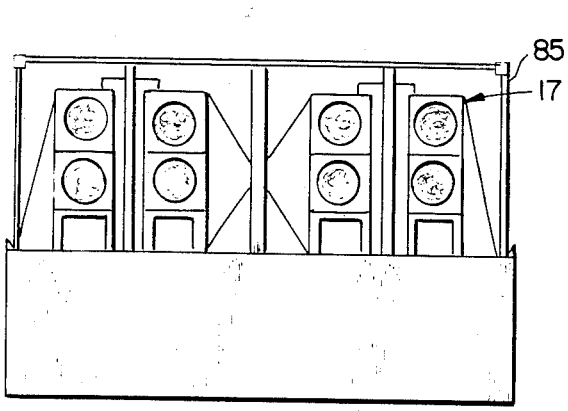
FIG. 16 is an enlarged end elevation of the vessel as seen from lines 16—16 in FIG. 15.

Such a system comprises a container barge 40 and a tether 19 releasably coupled to barge 40 and buoy 18. The stern portion of barge 40 is releasably coupled to the incinerator barge 41 by shock absorber 39. Barge 41 carries the incinerators 17. Crane 38 insures that the disconnectable pipe 37 allows liquids to pass from barge 40 to barge 41. The coupling between barge 40 and barge 41 together with the tether will allow both barges to swing with the wind so that the plume 86 from oxidizer 27 of each incinerator 17 will be blown downwind. A wind-driven electrical generator 35 (FIG. 15) may be installed to take advantage of the predictably favorable wind direction. A fan 36 (FIG. 15) may assist movement of the plume away from the barges and crew and in a downwind direction. FIGS. 15 and 16 also show a water curtain spray rack 85, mounted astern of the incinerator and extending the width of the vessel, from which inwardly directed sprays of water scrub the effluents 86 as they emerge from the incinerators.

Figure 7:
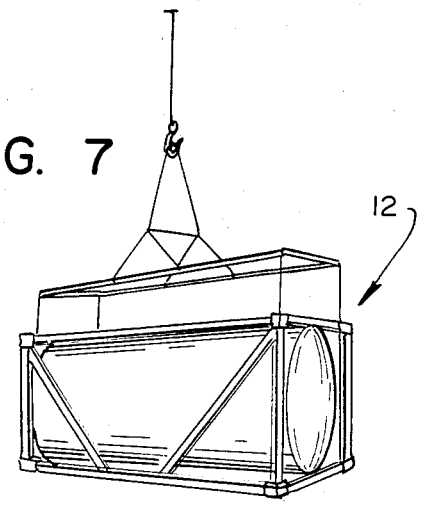
FIG. 7 is a perspective view of a typical intermodal tank container containing hazardous liquid waste material as it would appear while being lifted to be placed aboard the vessel.
Figure 6:
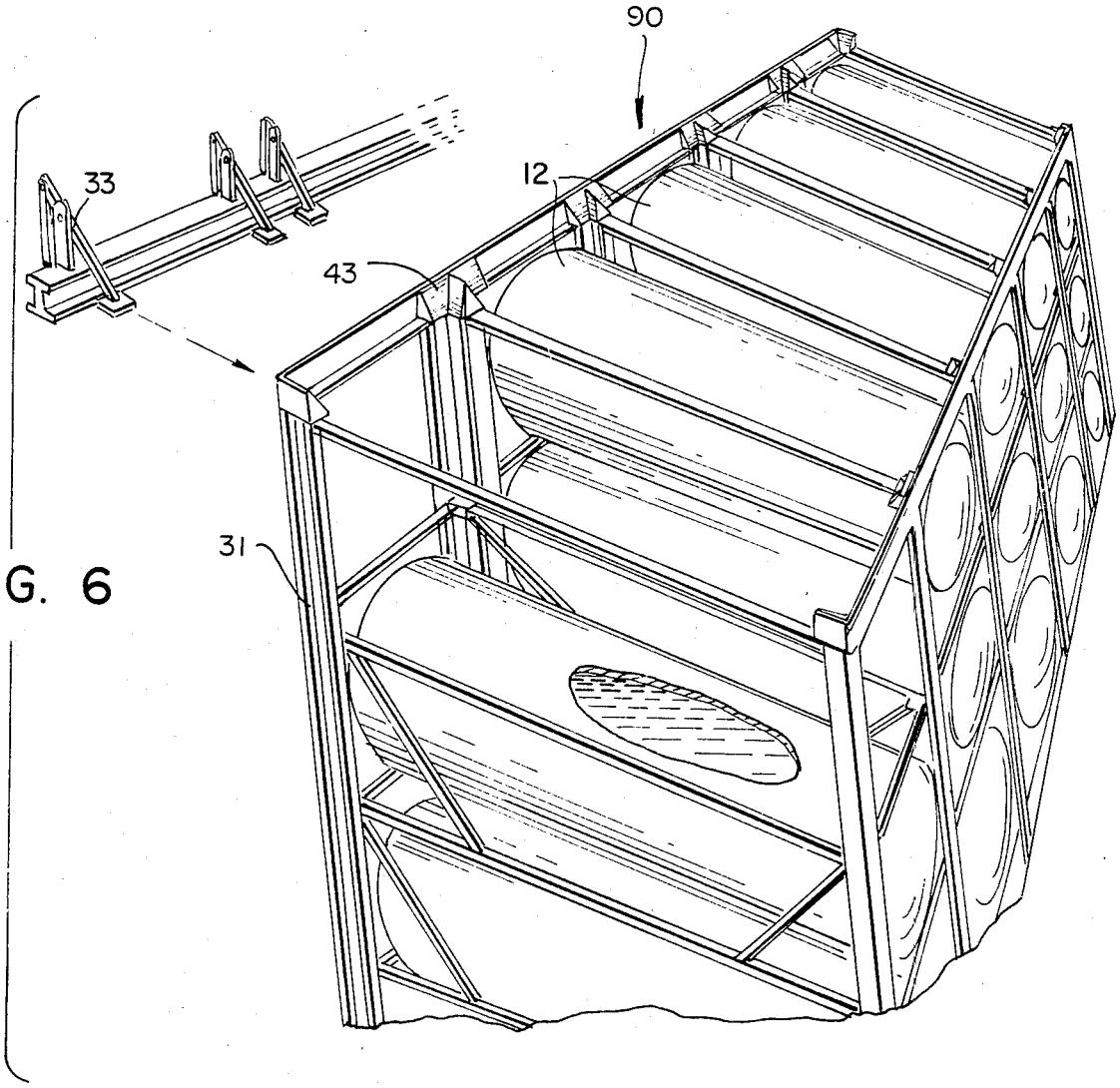
FIG. 6 is a further enlarged fragmentary view in perspective and partly in section of a group of stacked intermodal tank containers as they would appear on board the vessel shown in FIGS. 2–6, including an exploded showing of the manner of securing the containers thereon.
Figure 9:
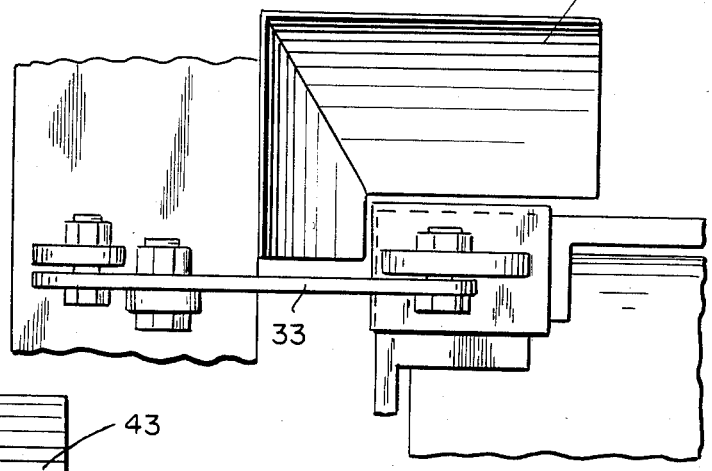
FIG. 9 is a plan view of the device illustrated in FIG. 8.
Figure 8:
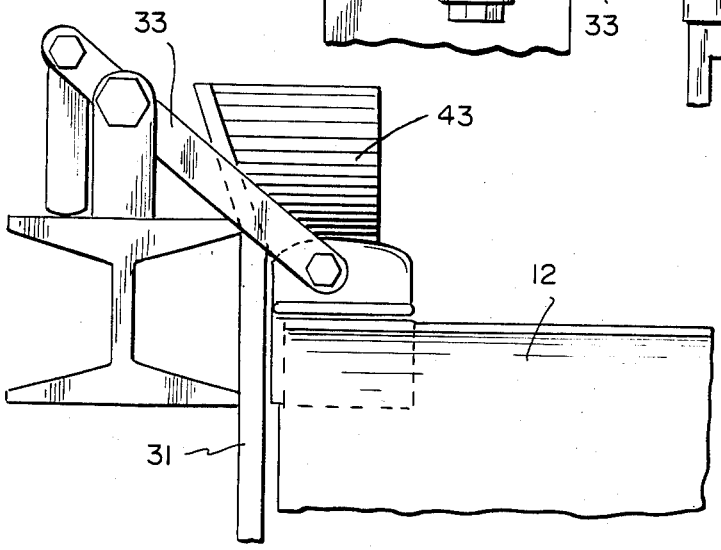
FIG. 8 is a greatly enlarged and fragmentary elevational showing of a device for securing the intermodal tank containers within the container guides aboard the vessel.

The housing of the containers, such as tanks 12 on the barge 40 comprises a cell structure 90 as illustrated in FIG. 6. Cell guides 31 are fastened to the deck. The upper end of the cell guides are connected to a fairing plate 43. Holding down devices 33 are arranged to prevent a stack of containers, such as a stack of three, being dislodged. Details of the construction of the holding down device 33 are illustrated in FIGS. 8 and 9. Cell guides 31 and fairing plates 43 are provided to facilitate the insertion of the containers illustrated in FIG. 7. The containers are thus securely held on the barge to prevent movement of the containers.

Figure 12:
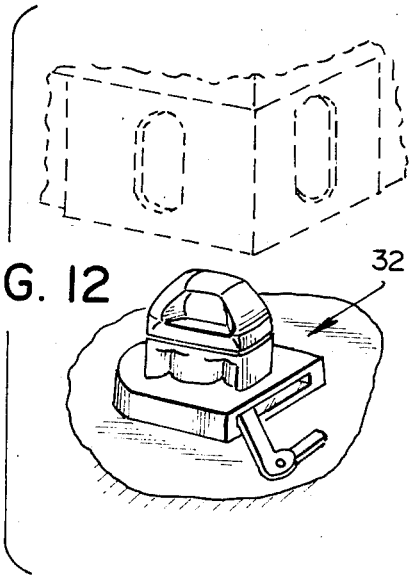
FIG. 12 is a greatly enlarged fragmentary perspective illustration of a locking device used in the incinerator mounting arrangement of FIGS. 10 and 11.
Figure 20:
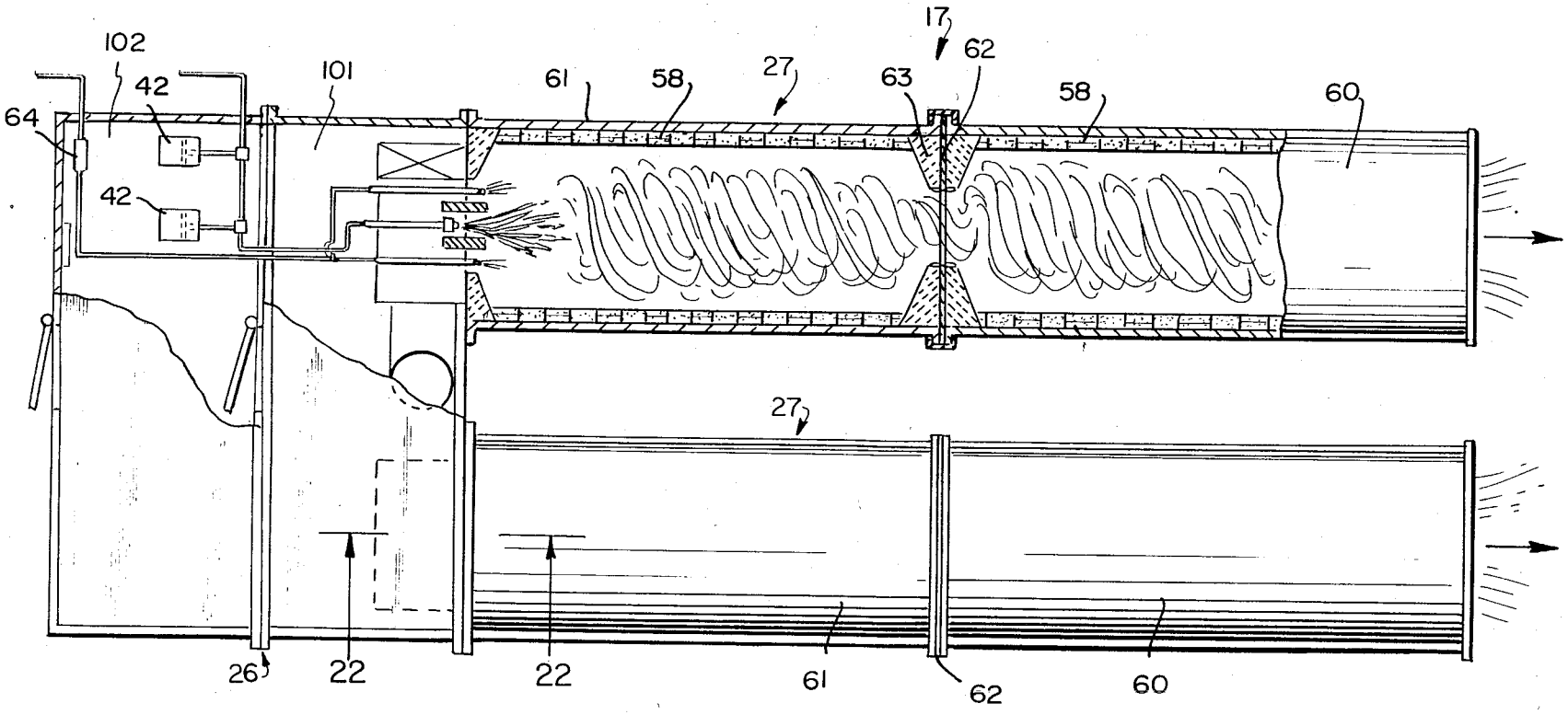
FIG. 20 is an enlarged plan view, partially in section, of a pair of incinerator units for mounting on a vessel in accordance with the invention.

As stated above, the detailed assembly of each incinerator 17 is shown in FIG. 20, using its modular burner and pump components 26 and its oxidizer component 27. Several assemblies of incinerators 17 may be grouped together, transversely adjacent to one another and in vertical tiers as shown in FIG. 11, in order to increase the overall waste disposal capability of the vessel. In the arrangement shown in FIGS. 2 and 3, eight incinerator pairs of assemblies are provided; in the arrangement shown in FIGS. 13, 14, 15 and 16, four paired assemblies are provided. The number of assemblies is a function of the width of the incineration vessel and how many tiers are utilized. Two tiers are illustrated, as typical. Securely fastened to deck 28 are stanchions 87 onto which the lower tier incinerators are fastened. Locks 32 (FIG. 12) hold the incinerators in position. The details and operation of such a lock are disclosed in U.S. Pat. No. 3,894,493. The upper tier incinerators are similarly secured to the lower tier. The spacing of the incinerators from the deck will permit air and water to pass underneath the incinerator.

There is an option to double-tier the incinerator installations and to use intermodal modular incinerator units. Further details of the incinerators 17 using this option and of its control panel are illustrated in FIGS. 20, 21, 22 and 23. There may be a plurality of incinerator installations on the vessel an incinerator installation consists of an assembly of oxidizer modules 60 and 61 housing the principal combustion chambers, burner modules 101 housing the burners (FIG. 22) and pump room modules 102 housing the duplex liquid pumps 42 (FIG. 23) and fuel pump 64, each module having the same size, which is that of an intermodal shipping container as illustrated in FIGS. 10, 11 and 20, e.g., each having dimensions 20 feet long by 8 feet high by 8 feet wide. The geometrical configuration of the oxidizer modules, burner modules and pump room modules may vary. The number of modules may also be changed.

Figure 21:
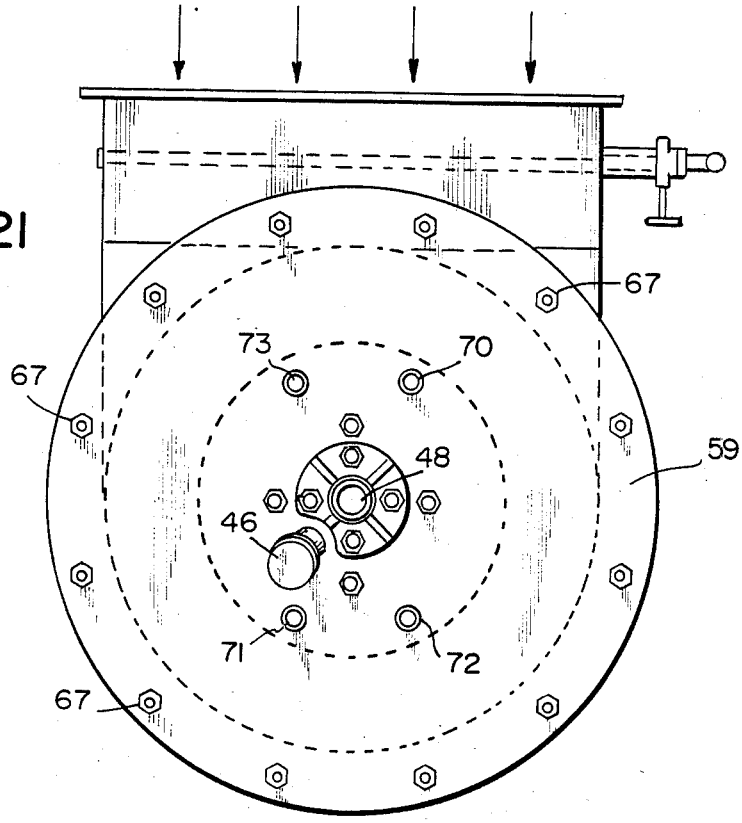
FIG. 21 is a still further enlarged end view of the burner end of one of the incinerators illustrated in FIG. 20, as seen from the left side of FIG. 22.
Figure 22:
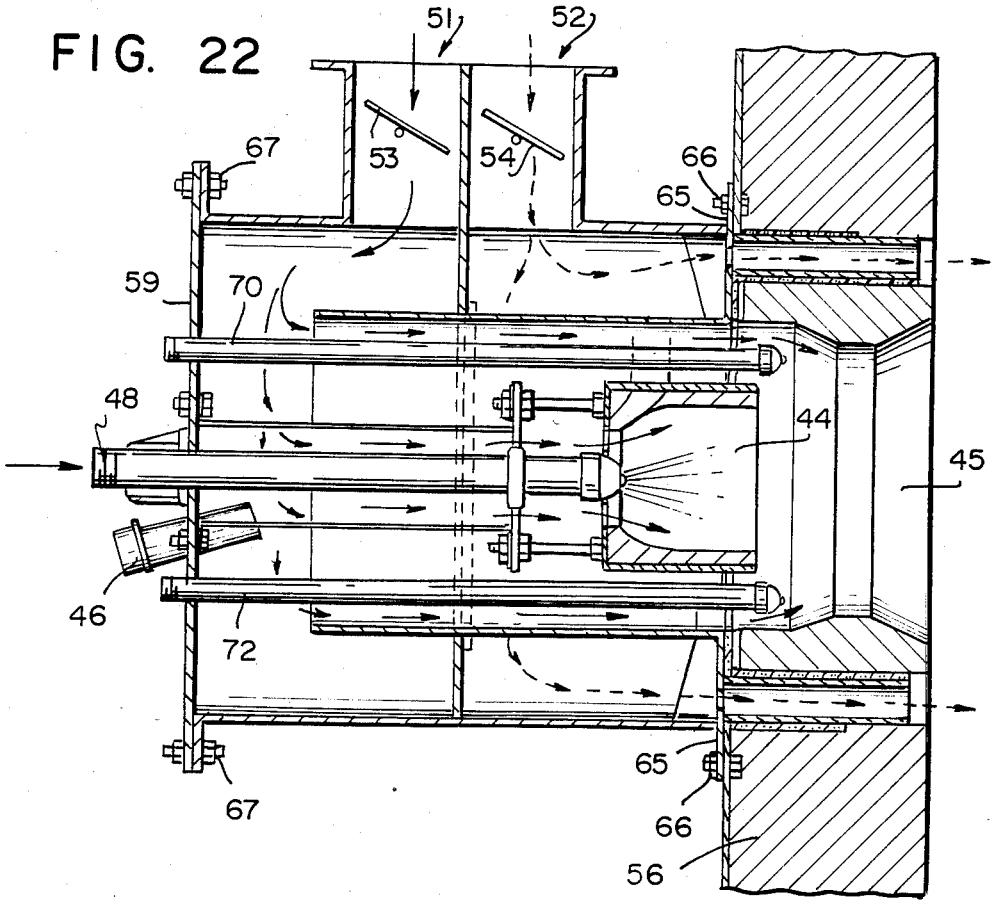
FIG. 22 is a sectional side elevation, to the scale of FIG. 21, of the burner portion of one of the incinerators as seen from lines 22—22 in FIG. 20.

The main hazardous waste burner 48 of FIGS. 21 and 22 is surrounded by four supplementary burner nozzles 70, 71, 72 and 73 for better flow control when burning wastes of either very high or very low viscosities. The vaporizing section 44 and the primary combustion chamber 45 indicate the direction of the movement of the combustion gases. A primary combustion air inlet is shown at 51. In the air inlet 51 is located a damper 53. The secondary combustion air inlet is shown at 52. A damper for the secondary air inlet 52 is shown at 54. The burner is monitored by ultraviolet scanner 46.

The incinerator plant may have a modular frame construction as in FIG. 20 to facilitate maintenance, also removing modules without unduly interrupting the operation of the incinerator. A back cover 59 as shown in FIG. 22 is removably attached to the burner end. The front wall of the incinerator is indicated at 56.

The incinerator oxidizer modules 27 are attached to the burner modules 101 by front plate 65 secured to the front wall by bolts 66. The combustion area is lined with fire bricks 58. The joint between parts 60 and 61 is insulated by a cast refractory bridge 63. Mortar and/or anchor studs are used to secure the fire bricks 58 to each other and to the cast refractory bridge 63. A gasket 62 is inserted between the parts 60 and 61 to prevent escape of toxic gases. The burner modules 101 are fastened to the pump room modules 102 by standard container attaching devices, similar to the device 32 shown in FIG. 12.

Figure 23:
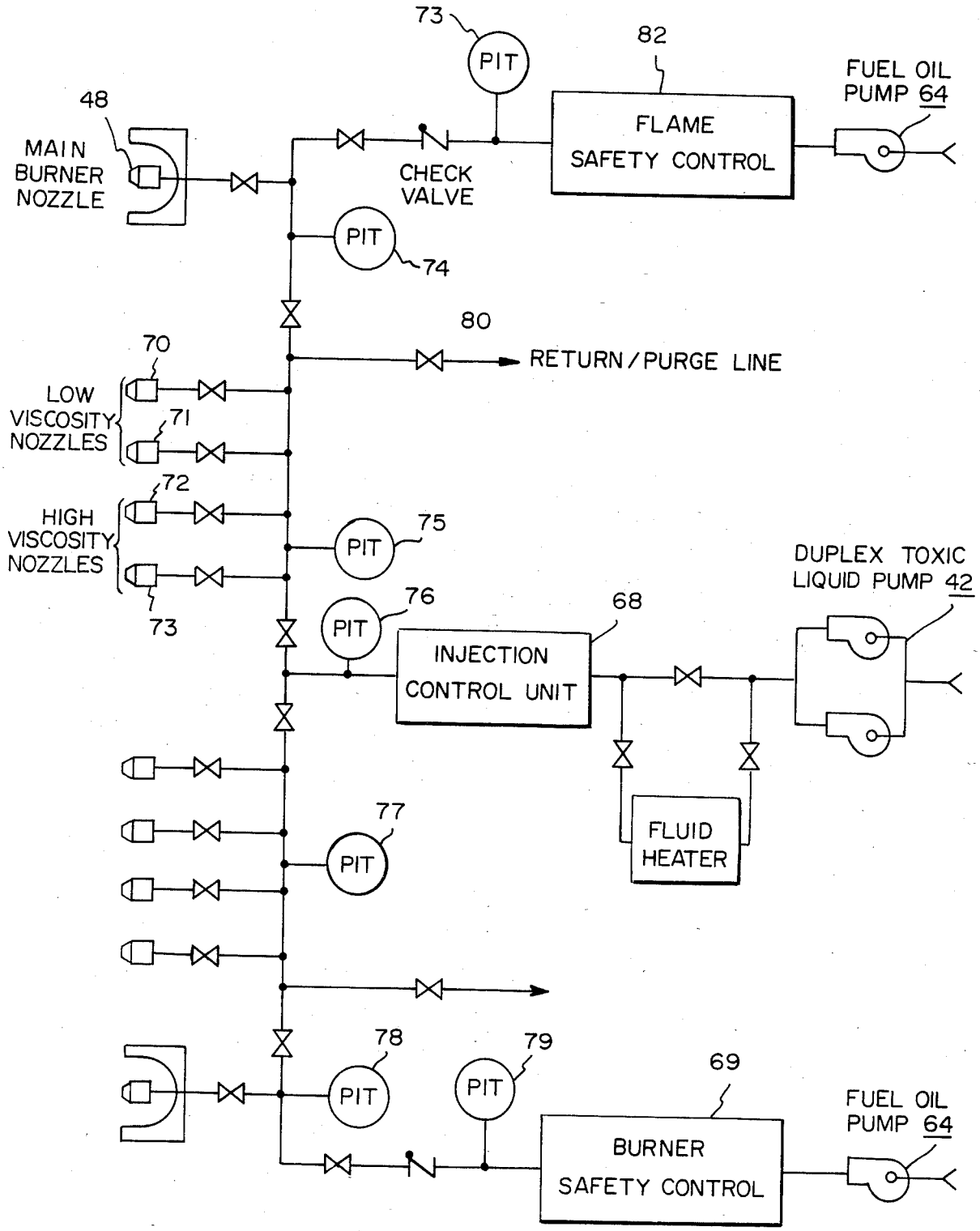
FIG. 23 is a diagrammatic illustration of one type of valving arrangement for the incinerators.

The incinerator operates as follows. The hazardous waste will be injected into the vaporizing section 44 of the burner. The high temperature will allow the liquids to vaporize prior to entering the primary combustion chamber 45. These vapors are mixed with sufficient combustion air to allow the maximum oxidation. The oxidation temperature may reach 1600° C. The operation of the fuel pumps 64 is controlled and monitored by the burner safety control 69 and flame safety control 82 (FIG. 23).

Similarly, the duplex hazardous waste pumps 42 are monitored and controlled by the waste injection control unit 68.

In order to enable the incinerator to be operated and incinerate waste of different viscosities, two low viscosity nozzles 70 and 71 and two high viscosity nozzles 72 and 73 are provided. A number of pressure indicator transmitters 74, 75, 76, 77, 78, 79 and 80 are provided. The main control panel 83 (FIG. 1) incorporates besides others, a monitor for an ultraviolet scanner 46. The main control panel will monitor all sensors and act as a main control system. The waste injection control unit monitors the flow, viscosity, pressure, temperature and pH of the waste material introduced into the burners. These data transmitted to the main control panel will be compared in the panel with the program. Appropriate steps are taken by the main control panel to maintain the combustion within the limits established by the program.

The main control panel 83 located in the forward deck house (FIG. 1) or aft in the incinerator control room includes the main computer containing the program, disk data storage, disk program storage, multiple CRT display, ship-to-shore communication and will act as a primary monitor and control station for the system. All data will be converted into a computer code and fed into a communication system interface. A backup panel will be located remotely and have duplicate control capacity to act as a standby operational unit.

Figure 13:
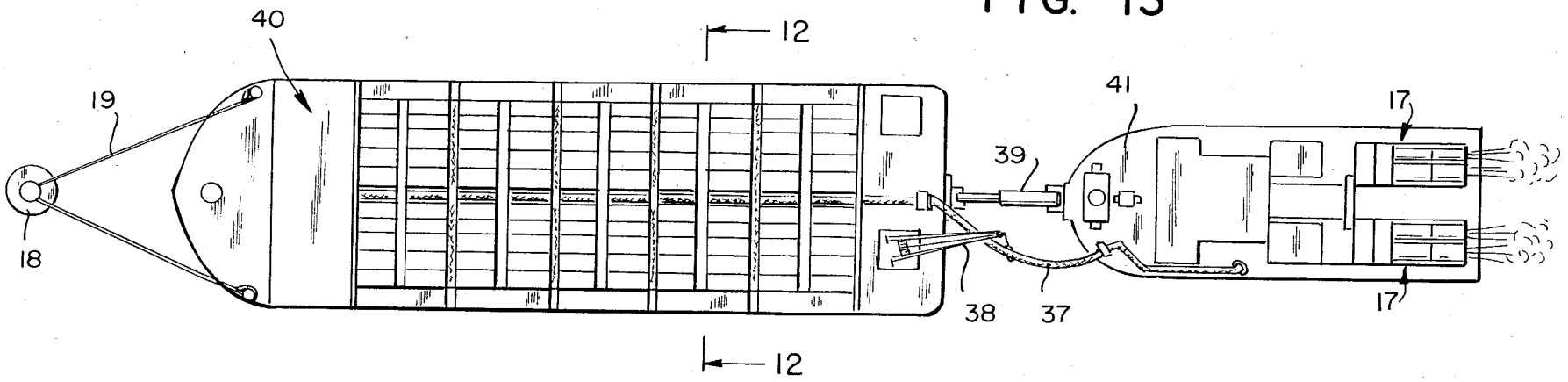
FIG. 13 is a top plan view of a modified vessel arrangement in accordance with the invention.
Figure 14:
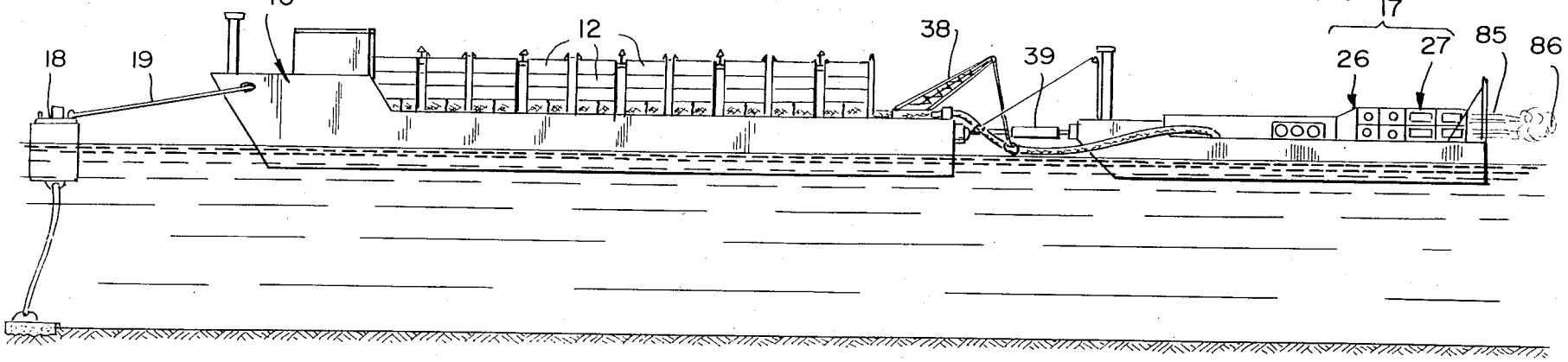
FIG. 14 is a profile view of the vessel arrangement shown in FIG. 13.
Figure 17:
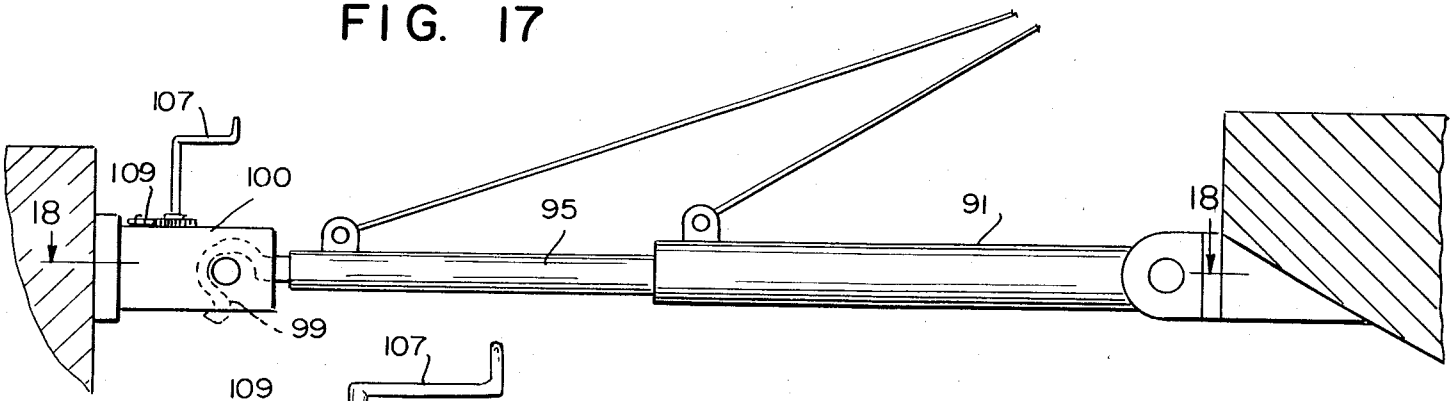
FIG. 17 is a still further enlarged side view of a connector device for use between the vessels shown in FIGS. 13 and 14.
Figure 19:
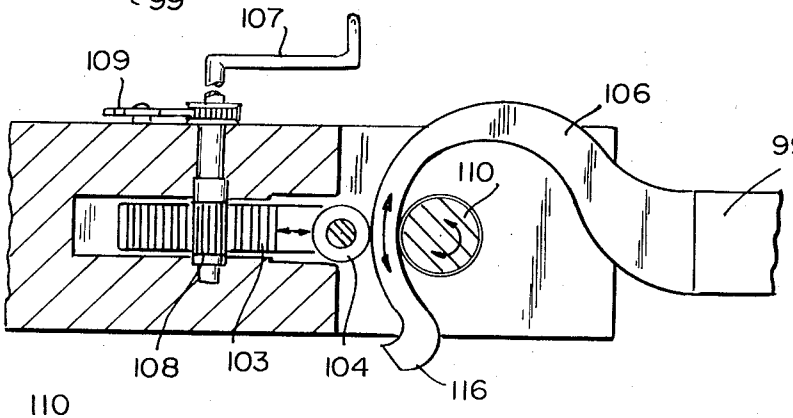
FIG. 19 is a further enlarged and fragmentary sectional view as seen from lines 19—19 in FIG. 18.
Figure 18:
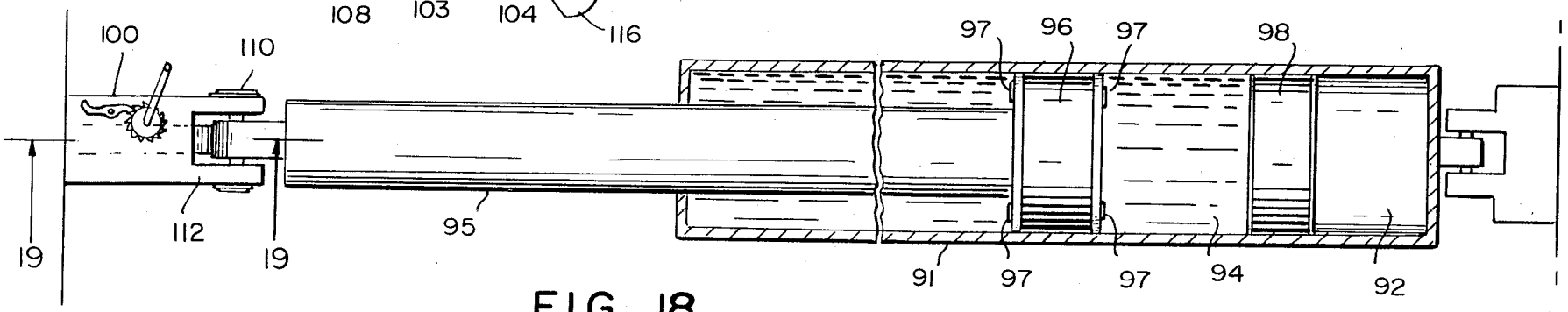
FIG. 18 is a top view, partially in section, as seen from lines 18—18 in FIG. 17.

The details of the shock absorber 39, generally shown in FIGS. 13 and 14 are illustrated in FIGS. 17, 18 and 19. The shock absorber is of a type generally referred to as oleo-pneumatic, the oil operating as a damper and the air as a spring. Cylinder 91 is filled on its right hand (FIG. 18) with air 92. Floating piston 98 separates the air space from oil space 94 containing the damping oil and which occupies the remainder of the cylinder space. Piston rod 95 carries on one end the piston 96 provided with valves 97 to regulate the passage of oil through the piston 96 and thus provide damping of the movement of piston 96 in a conventional manner. The other end of the piston rod contains a device to regulate and control the relative position of the two barges and oscillating movement due to the action of the waves.

More specifically, the outer end of piston rod 95 is provided with a hook-type extension 99 (FIG. 17) which is placed in an anchoring device 100 of the container barge 40. Spindle 110 (FIG. 18), rotating in the arms 112 of the anchoring device 100, carries a pinion 108 for moving rack 103 to and from friction wheel 104 which in turn presses against the operating portion 106 of hook 99.

The operating portion of 106 (FIG. 19) is arcuate and of equal widths over an arc of approximately 45 degrees. The bent portion 106 of hook 99 and the end portion 116 of hook 99 limit the relative movement of the hook in relation to the anchoring device 100 and, therefore, the relative movement of the two barges. Handle 107 has a splined pinion 108 cooperating with the gears of rack 103. Movement of handle 107 will increase or decrease, as the case may be, the pressure of rack 103 against friction wheel 104. A ratchet pawl 109 is provided to lock handle 107 in its position.

Pressure of friction wheel 104 against the operating portion 106 will also press against the inner friction wheel 110 which presses against arc 106. A substantially calibrated reduction of dynamic surge, yet tolerably vertical movement between the two barges is accommodated in this manner. Horizontal movement is restrained by lashing cables between the two vessels at both port and starboard sides.

The arrangement in which two support vessels are utilized, one carrying the cargo, the hazardous waste, and the other vessel carrying the incinerator will provide both substantial technological and economical advantages.

That is, the sea-going vessel carrying the incinerator can be left at the incinerator station for an indefinite time. The vessel carrying the cargo can be exchanged for the next vessel carrying full cargo when the first carrying vessel has its cargo consumed by incineration. Substantial uninterrupted incineration is obtained.

The incinerator itself, at least part of it, is lined with fire bricks which are heated to about 1600° C. The fire bricks are held together and possibly to their outer shell by mortar capable of remaining intact at the operating temperature. A cooling down to a substantial degree will adversely affect the mortar, increase the maintenance work and lead to premature failure of the incinerator. The maintenance work, the expense thereof and the delay of time will be substantially decreased by keeping the incinerators in continuous service.

The horizontal position of the incinerator will reduce the dispersion of the exhaust gases, including the danger to the crew and passing vessels. Exhaust gases may be even more hazardous and corrosive than the materials in their original liquid state.

Sectional or modular construction of the incinerator promotes the continuous operation of the incineration process, since single modules can be removed for replacement and maintenance, permitting the incinerator to be restored quickly to on-line operation.

Referring now to FIGS. 24–29 which illustrate a preferred embodiment of a vessel in accordance with the invention, the vessel is a sea-going barge 200, although it might incorporate its own power plant and propellers to be self-propelled. At its forward end or bow 201 the vessel is adapted, as indicated by tow lines 202, for towing by a sea-going tug (not shown).

Figure 24:
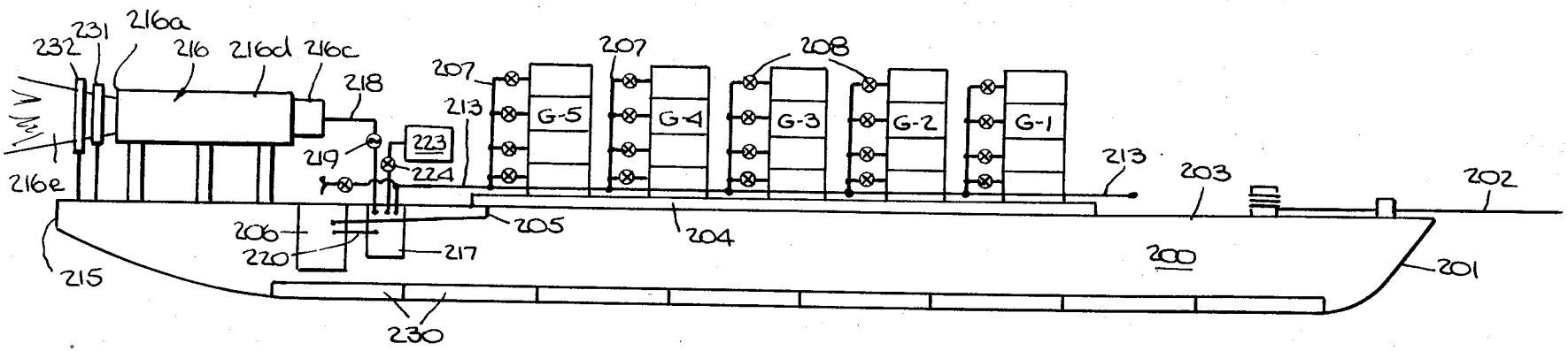
FIG. 24 is a diagrammatic profile of a sea-going incinerator barge-type vessel in accordance with a preferred embodiment of the invention.
Figure 25:
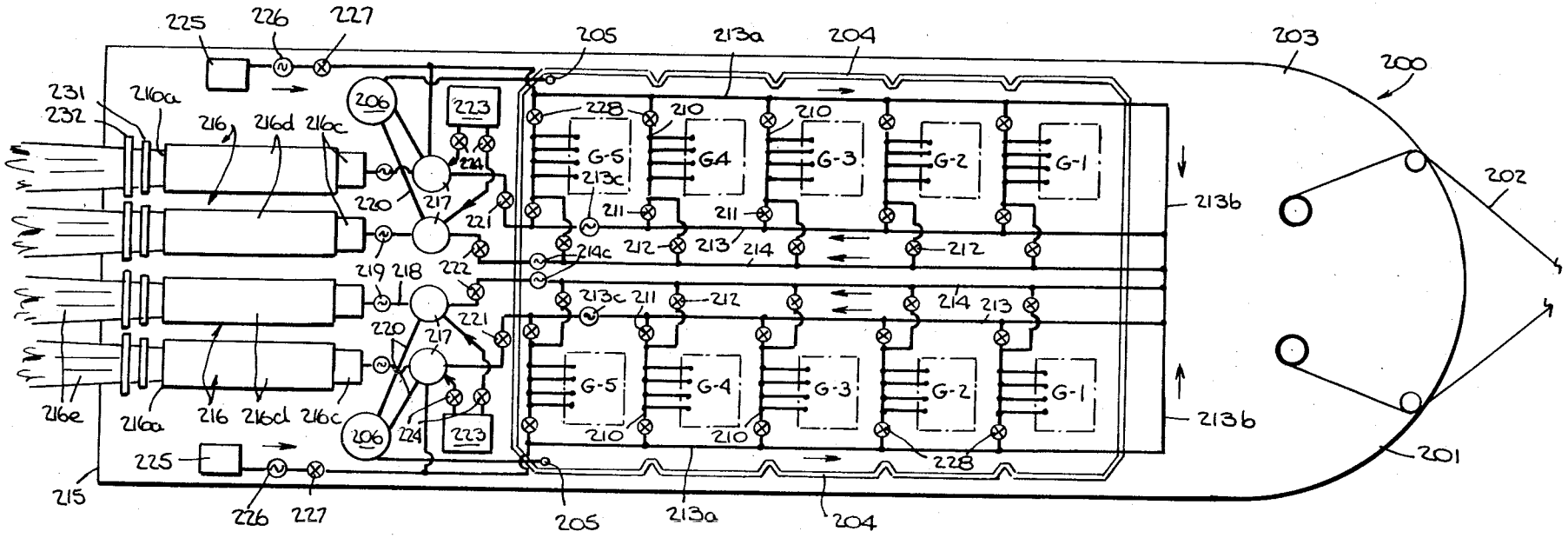
FIG. 25 is a diagrammatic deck plan view of the vessel of FIG. 24.

With particular reference to FIG. 24, the vessel 200 has a weatherdeck, in this case a main deck 203, having upwardly projecting cell or container guides 31 (FIG. 26) thereon, appropriately spaced and connected to form cell or container guide structures 90 on and projecting upwardly from the main deck 203 for receiving and storing intermodal tank shipping containers 12. When loaded between the guides, the containers 12 are preferably aligned in the longitudinal direction, and disposed in longitudinally spaced apart, port and starboard container groups, for example Groups G-1 to G-5, on the vessel 200, as indicated in FIGS. 24 and 25. Alternatively, the tank containers 12 may be disposed athwartship (not shown) with suitable arrangements of the piping system and cell guides.

Figure 26:
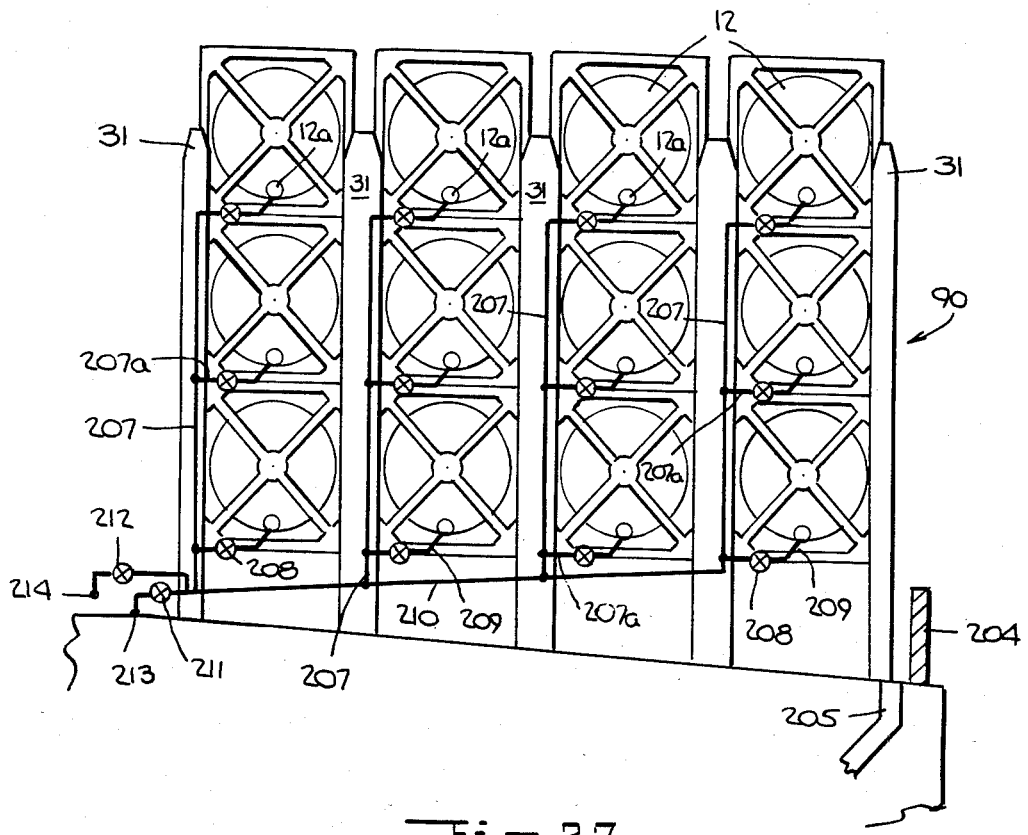
FIG. 26 is an enlarged and fragmentary, diagrammatic transverse sectional illustration of the piping to the containers carried on the vessel of FIGS. 24 and 25.

A bulwark 204 as seen in FIGS. 24-26 projects upwardly from the main deck and surrounds the areas beneath the container groups G-1 to G-5, port and starboard, to retain any spillage from the containers 12. Because of the camber of the ship's main deck, the flow of any such spillage will be outboard to the bulwark 204 which will direct the flow into scuppers 205 which, in turn, direct the spillage into an associated one of a pair of port and starboard side, pollution abatement tanks 206, both being situated below the level of the main deck 203.

With reference to FIG. 26, individual vertical pipe risers 207, attached to the guide structure 90, service the respective stacks of containers 12 as part of the network of pipe conduits on the ship's main deck for receiving the flow of liquid wastes from the containers 12 when the waste material is to be incinerated.

The respective branches 207*a* from each riser which extend towards the discharge outlets 12*a* of the respective containers are at elevations corresponding to the bottoms of the containers 12 to permit gravity flow from the latter. Each branch 207*a* has a shutoff valve 208, to which a length of flexible hose 209 is connected. A quick-connect pipe coupling (not shown) connects the other end of each flexible hose 209 to one of the container discharge outlets 12*a*, as will be understood from FIG. 26. Of course, each container outlet 12*a* has a shutoff valve (not shown), as is conventional. During discharge operations, containers 12 may be vented through a vacuum release valve installed at the top of the tank shell or, where necessitated by the hazardous characteristics of a particular waste, an inert gas may be admitted to the interior of the shell through the discharge valve or other appropriate pipe connection of the tank container.

As also seen in FIG. 26, the lower ends of the vertical pipe risers 207 serving any container group connect into a common transverse header pipe 210 which is pitched towards the pair of longitudinally extending header pipes located amidships on the main deck 203, so that gravity flow from the containers can be maintained. Respective valves 211 and 212 direct the flow into either or both of the longitudinal conduits 213, 214, as will also be understood by reference to FIG. 25. As shown in FIG. 25, an identical vertical riser pipe and transverse header piping arrangement is disposed in the longitudinal spacing between each of the container groups, and a second, identical system, including a second pair of longitudinally extending conduits 213, 214, services the container groups along the opposite side of the vessel 200.

As indicated by the arrows adjacent the longitudinal conduits 213, 214, these lines are pitched towards the stern end 215 of the vessel 200, to maintain gravity flow of the draining liquid waste towards the incinerators 216, four of which are mounted on the main deck 203 at the stern 215 of the ship. Line pumps 213*c*, 214*c* may be used to assist the flow of more viscous liquids. The flow in any of the conduits 213, 214 is directly into one of the product staging sumps 217 from which it is pumped into the burner portion 216*c* of one of the incinerators 216 via the sump outlet line 218, which includes a pump 219. Each of the staging sumps is located below the main deck, as seen in FIG. 24, and is preferably a cylindrical tank approximately four feet in diameter and 8½ feet high. Each has overflow piping 220 leading to one of the pollution abatement tanks 206, as shown in FIGS. 24 and 25. However, each sump 217 is equipped with both a high level alarm and a low level alarm (not shown). When the high product level alarm is actuated by a full sump 217, the flow of product from one of the lines 213, 214 is reduced or terminated by closing one of the valves 221 or 222 (FIG. 25) until the product level drops as the waste is pumped from the sump to its associated incinerator. When the product level drops and the low level alarm is actuated, as when the emptying container 12 has been completely emptied, in order to keep the associated incinerator burning until the flow of the waste product is resumed, coming from another container 12, diesel fuel from a supply tank 223 is introduced into the low level sump. The diesel oil is introduced by opening one of the diesel oil tank valves 224 and, of course, the incinerator pump 219 will pump the diesel oil into the associated incinerator to maintain its flame.

Any overflow from a sump 217 into an abatement tank 206 can be returned to the sump by pumping, when the sump level is again within normal range.

It will be noted that the described piping and sump arrangement permits controlled and selective incineration of the several different types of liquid wastes as may be contained in the many containers 12. Moreover, one or more container groups may be dedicated to handle a particular type of waste. For example, container group G-5 might be dedicated to containers having wastes which are flowable only on heating and, therefore, steam lines (not shown) may lead to the container supporting structure 90 of the group, to be introduced into steam chambers (not shown) at the bottoms of the respective containers 12 which are stored in this group. Such particular waste product may then be directed into a particular staging sump 217 which services a particular one of the incinerators 216 which is maintained at an appropriate burn temperature for that cargo, which can remain unblended. However, it will be noted that diesel oil may be added to the product before or while it is burned, if desired for improved burning efficiency, by opening the appropriate diesel fuel valve 224. Or, if desired, the cargo may be blended with more flammable cargo from another container stored in a different group but along the same lines 213, 214, and it will be noted that the blending can take place only when both products reach the sump 217 via separate lines 213 or 214.

The transverse header pipes 210 and the longitudinal conduits 213, 214 are cleaned by pumping cleaning solvent or the like therethrough from a solvent tank 225 (FIG. 25), using the solvent pump 226. The solvent flows from the pump 226, through the valve 227, into the loop piping 213*a* along the outboard side of the pipe network, and then via the crossover piping 213*b* located nearest the bow 201, or via the header pipes 210 by opening their respective valves 228, into the main longitudinal conduits 213, 214, so that all piping is easily cleaned. It will be noted that the dirty solvent drains into the sump 217, from which it may be pumped into the incin-erators 216 to be incinerated.

Turning now to the operation of the horizontal incinerators, from FIG. 24 it will first be noted that their effluent discharge outlets 216*a* which face in the aft direction of the ship from its stern 215, may be pitched at a downward angle towards the sea by ballasting the ship, as by filling ballast tanks 230, to trim the ship by its stern. Thus, the effluent discharge 216*e* will reach and impinge upon the ocean or waterway more promptly.

Figure 28:
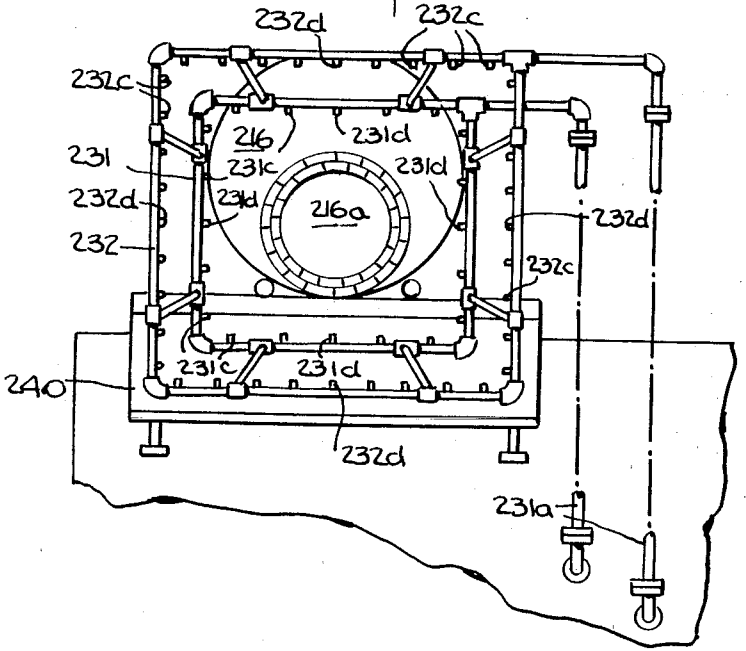
FIG. 28 is a fragmentary end view of the incinerator as seen from line 28—28 in FIG. 27.
Figure 27:
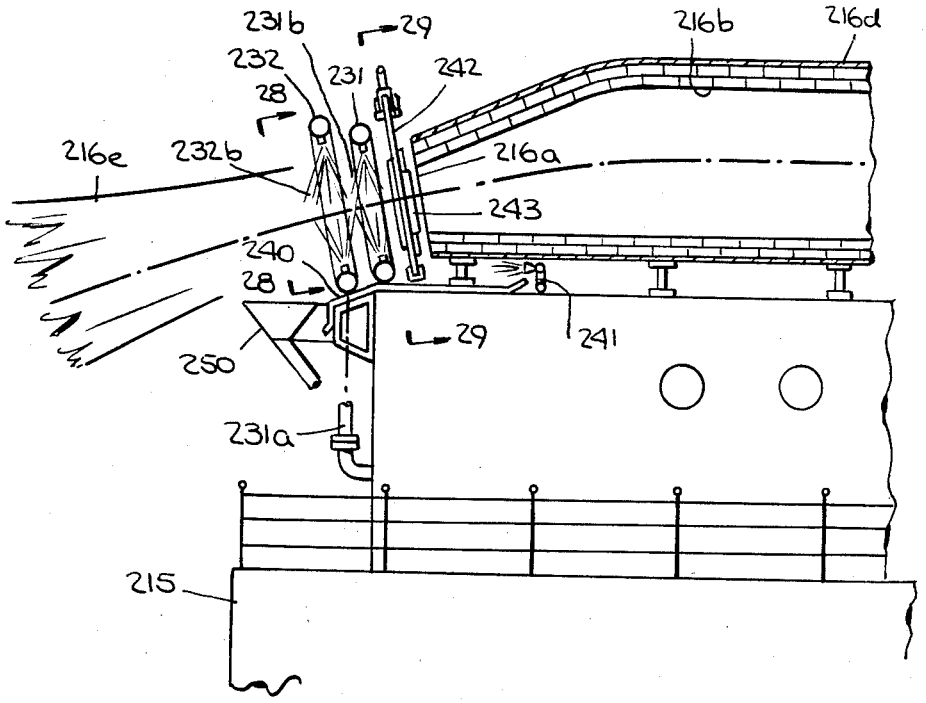
FIG. 27 is a fragmentary sectional profile showing of certain details of one of the incinerators on the vessel of FIGS. 24 and 25.

Alternatively, and preferably, the effluent discharge outlet may be shaped to provide a downward sloping angle of discharge of the effluent streams, as illustrated in FIG. 27 and 28. That is, the aft-facing effluent discharge outlet 216*a* of the oxidizer portion 216*d* of each incinerator 216 is canted inwardly in the downward direction of its otherwise vertical plane, providing a downward discharge angle of from about 15° to about 25° from the horizontal. In addition, the upper wall portion 216*b* of the oxidizer 216*d* is given a downward slope, to turn the gases downwardly as they begin to emerge through the outlet 216*a*. Thus, the discharging effluent gases 216*e* from each incinerator are directed at a downward sloping angle towards the water, to strike the water and be diluted by it in the shortest possible time.

In order to rapidly cool the emerging gases 216*e* to reduce their temperature and, consequently, their thermal lift, each incinerator is provided with preferably two sea water scrubbers 231, 232, the two being disposed about 1½ to 2 feet apart in the longitudinal direction, and the innermost scrubber 231 being located about one foot or so aft of the plane of the discharge outlet 216*a*. Water is pumped to the scrubbers 231, 232 via the conduit 231*a* (FIG. 27).

As illustrated in FIG. 28, each scrubber 231, 232, is preferably a square shaped piping spray rack arrangement concentrically disposed with reference to the imaginary central longitudinal axis of the incinerator through its discharge opening 216*a*. As shown, the outer scrubber 232 is somewhat larger than the inner scrubber 231 to accommodate the rapidly expanding gas stream 216*e*, as will be understood. Each scrubber has a plurality of water spray nozzles 231*c*, 232*c*, spaced about 1 foot apart about the interior periphery of the spray rack. The nozzles 231*c*, 232*c*, of both spray racks 231, 232 are so directed that the water spray cones 231*b*, 232*b* overlap to provide complete coverage of the incinerator gas stream with the desired watercurtain, as illustrated in FIG. 27 and shown generally in FIGS. 15 and 16. The mid-length nozzles 231*d*, 232*d* will impart higher velocities so that the streams of sprayed water 231*b*, 232*b* will reach the center of the discharging effluent stream 216*e*.

As also seen in FIG. 27, below the incinerator outlet 216*a* and extending rearward under the scrubber spray racks is a sheet 240 of stainless steel or similar non-corrosive material coated with a protective coating. This sheet 240, which slopes downwardly in the aft direction as shown, will minimize contact of the highly corrosive effluent gases 216*e* and scrubber water with the ship's structure. A continuous spray of sea water, indicated by reference numeral 241 will flush the contaminants towards and over the stern 215, via drip caps, downspouts, gutters or the like (not shown).

The use of scrubbers, particularly the illustrated two-phase scrubbers, which scrub the horizontally emerging effluent stream with cold sea water, causes virtual elimination of the thermal lift of the effluent, so that it falls rapidly into the sea. As a result, these highly acid gases will not rise into the higher elevations to subsequently descend as harmful acid rain. Calculations indicate that the temperature of the oxidizer effluents, initially as high as more than 2000° F., will be reduced to approximately 230° F. by the two-phase scrubber as described.

Figure 29:
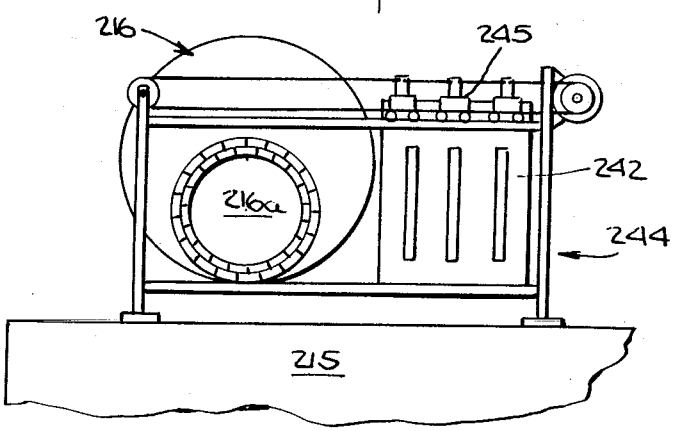
FIG. 29 is a fragmentary end view of the incinerator as seen from line 29—29 in FIG. 27.

Referring again to FIG. 27 and also to FIG. 29, a sliding incinerator cap is mounted immediately adjacent to each incinerator outlet 216*a* to plug the incinerator outlet when the incinerator is shut down, thus to retain the heat within, and reduce the use of fuel during the next startup. Capping the incinerator also minimizes thermal shock to the incinerator refractory from ambient air temperature, sea spray, rain, etc. Accordingly, a steel curtain door or cap 242 having insulating material 243 on its inner, incinerator-facing side rides on a trolley structure 244 into and laterally out of the path of the discharge outlet 216*a*. The heavy steel cap 242 hangs vertically as it rolls laterally on its trolley wheels 245, but will be swung upwardly at its lower end, to the angled position shown in FIG. 27 conforming with the angular disposition of the inwardly canted plane of the discharge outlet 216*a*. Latches (not shown) latch the cap 242 in closed position on the outlet.

Again with reference to FIG. 27, the sprays of sea water from the scrubbers 231, 232 entrap many emerging fine particulate materials within the gas stream, as well as dissolving much of the gases themselves. Accordingly, the efficiency of incineration may be monitored not only by sampling and analyzing the gases emerging beyond the stern of the ship, but also by sampling and analyzing the residue scrubber water itself. For such purpose, in FIG. 27 there is a diagrammatic illustration of a stern sampling trough 250, located beneath the falling scrubber sprays, for collecting samples of the spray water after passing through the effluent stream, for subsequent analysis.

Thus, techniques and vessels for offshore incineration of hazardous liquid waste material have been described which achieve all of the objects of the invention.

What is claimed is:

1. A method for disposing of hazardous waste material, comprising transporting said waste material to an offshore burnsite location, incinerating said waste material in an incinerator disposed at an elevation above water level at said burnsite location, and directing the effluent discharge from said incinerator in a generally horizontal stream towards the water to substantially avoid the stream being carried aloft.

2. A method according to claim 1, wherein said stream of effluent discharge is directed in a downwardly sloping direction towards the water.

3. A method according to claim 2, wherein said incinerator is an elongated horizontal incinerator mounted on board a vessel, and said method further comprises ballasting to trim said vessel whereby the effluent discharge outlet of said incinerator faces in said downwardly sloping direction.

4. A method according to claim 1, which further comprises scrubbing said stream of effluent discharge by spraying sea water into the stream as it emerges from said incinerator.

5. A method according to claim 4, which further comprises similarly scrubbing said stream of effluent discharge a second time substantially as said stream emerges from the first said scrubbing step.

6. A method according to claim 1, wherein said waste material is substantially liquid material and is transported to said burnsite location in liquid-carrying intermodal tank shipping containers, and said method further comprises feeding said waste material from said containers into a staging sump, and pumping said waste material from said staging sump into said incinerator.

7. A method according to claim 6, which further comprises loading said waste material into each of said liquid-carrying intermodal shipping containers at respective land sites, and said transporting step comprises transporting said containers from said sites to a dockside and loading all of said containers on and above a weatherdeck of a sea-going vessel, and transporting said vessel to said offshore burnsite location.

8. A method according to claim 6, wherein said staging sump is mounted on a sea-going vessel at an elevation below a weatherdeck thereof, and said transporting step comprises loading all of said containers on and above said weatherdeck of said vessel, said waste material being substantially gravity-fed from said containers into each staging sump.

9. A sea-going vessel for incinerating liquid hazardous waste material, said vessel having a weatherdeck, an incinerator mounted substantially on said weatherdeck and having a substantially horizontally directed effluent discharge outlet, a staging sump for accumulating said waste material for feeding to said incinerator, and means for feeding said waste material from within said sump to said incinerator for incineration therein, whereby the products of said incineration emerge in a substantially horizontal direction from said incinerator effluent discharge outlet.

10. A vessel according to claim 9, wherein said incinerator is a horizontally oriented, liquid-waste type incinerator.

11. A vessel according to claim 10, wherein said incinerator has a burner portion and an oxidizer portion, at least said oxidizer portion having modular construction.

12. A vessel according to claim 10, wherein said vessel has a stern end, and said incinerator is mounted adjacent to said stern end with its said horizontally directed effluent discharge outlet facing aft.

13. A vessel according to claim 12, which further comprises wind generator means mounted for generating and directing wind adjacent to said incinerator discharge outlet to direct effluent gas emerging therefrom in said aft direction.

14. A vessel according to claim 12, which further comprises a downwardly sloping sheet of non-corrosive material beneath and extending aft of said effluent discharge outlet, and means for spraying sea water on said sheet of material to flush overboard any effluents from said discharge outlet which impinge thereon.

15. A vessel according to claim 12, wherein said incinerator discharge outlet has means for directing discharging effluents at a downwardly sloping angle from the horizontal.

16. A vessel according to claim 12, which further comprises sea-water scrubber means mounted adjacent to said incinerator discharge outlet for directing a spray of sea water into the stream of effluents discharging therethrough.

17. A vessel according to claim 16, wherein said scrubber means comprises annular water conduit means disposed substantially around the path of said stream of effluents, and nozzle means facing substantially inwardly with respect to said stream.

18. A vessel according to claim 17, wherein said scrubber means further comprises a second annular water conduit means longitudinally spaced from the first said water conduit means and disposed substantially around the path of said stream of effluents, and nozzle means facing substantially inwardly with respect to said stream.

19. A vessel according to claim 12, which further comprises incinerator cap means for covering and closing said incinerator discharge outlet and mounted for movement into and out of said covering relationship with said discharge outlet.

20. A vessel according to claim 10, which further comprises a liquid fuel storage tank, and means for feeding liquid fuel from said storage tank into said staging sump for fueling said incinerator therefrom.

21. A vessel according to claim 10, wherein said staging sump has an upper end disposed substantially at the elevation of said weatherdeck, a lower end extending below said weatherdeck, and an inlet for said waste material substantially adjacent to its said upper end, and which further comprises intermodal shipping container retaining means on said weatherdeck, and conduit means extending substantially between said container retaining means and said staging sump and including conduit connection means for connection to a container retained in said container retaining means for conducting waste material from said container into said staging sump.

22. A vessel according to claim 21, which further comprises a pollution abatement tank below said weatherdeck, bulwark and scupper means on said weatherdeck for directing any spilled waste material on said weatherdeck into said pollution abatement tank, and conduit means for conducting waste material between said pollution abatement tank and said staging sump.

23. A vessel according to claim 21, wherein said container retainer means comprises container storage cells for storing a plurality of liquid-carrying type intermodal shipping containers, and said conduit means between said container retaining means and said staging sump comprises a longitudinally extending conduit mounted on said vessel weatherdeck, and conduit means extending substantially between said longitudinally extending conduit and said storage cells and including respective conduit connection means for connecting respective containers mounted in said storage cells to said longitudinally extending conduit for directing waste material from said respective containers into said longitudinally extending conduit, and valve means on said conduit means for selectively directing said waste material from the respective of said containers into said longitudinal conduit.

24. A vessel according to claim 23, wherein said container storage cells comprise a plurality of vertical container guides for receiving a plurality of vertically stacked containers therebetween, and said conduit connection means comprises at least one vertical pipe riser substantially adjacent to said container guides and having a plurality of flexible hose connectors thereon which are respectively substantially adjacent to the locations for containers between said guides.

25. A vessel according to claim 24, which further comprises a plurality of said incinerators mounted adjacent to said vessel stern end, each said incinerator having a horizontally directed effluent discharge outlet facing aft, and respective staging sumps below said weatherdeck associated with each of said incinerators, and wherein said container guides are disposed for receiving a plurality of aligned rows of vertically stacked containers on and above said weatherdeck on each side of said vessel, said conduit means comprises respective pairs of longitudinally extending conduits each associated with all of said rows of containers on each side of said vessel, each of said longitudinally extending conduits being mounted on said weatherdeck and leading into one of said staging sumps, and said conduit connection means comprises a vertical pipe riser substantially adjacent to each of said rows of stacked containers on said vessel and respective, transversely extending conduit means mounted on said vessel weatherdeck to extend between each of said pipe risers and one of said pairs of said longitudinally extending conduits for selectively connecting the riser to either of said longitudinally extending conduits in the pair.

26. A vessel according to claim 25, which further comprises liquid fuel storage tank means, and means for feeding liquid fuel from said storage tank means into each of said staging sumps, and wherein each of said staging sumps has means for determining a predetermined maximum level and a predetermined minimum level of liquid therein, means activated by said determining means for terminating said feeding of waste material thereto when said predetermined maximum liquid level is reached, and means activated by said determining means for feeding liquid fuel from said storage tank means into said sump when said predetermined minimum liquid level is reached.

27. A vessel according to claim 26, wherein said vessel further comprises a plurality of pollution abatement tanks below said weatherdeck, conduit means extending from each of said staging sumps at the elevation of said maximum liquid level therein into one of said pollution abatement tanks, conduit means including pump means for pumping liquid contained in each of said pollution abatement tanks into one of said staging sumps, bulwark means on said vessel weatherdeck for containing liquid waste material spilled from any of said containers, and conduit means for conducting said spilled waste material from behind said bulwark means into one of said pollution abatement tanks.

28. A vessel according to claim 11, wherein said vessel has a pair of parallel and horizontal incinerators each having a burner end and an effluent discharge end and comprising an oxidizer portion formed by a tandemly connected pair of elongated oxidizer modules, an elongated burner module common to said pair of incinerators and extending transversly between and detachably connected to the respective of said oxidizer portions of the incinerator pair at said burner ends thereof, and a pump room module common to said pair of incinerators and detachably connected to said burner module in parallel adjacent relation thereto, the elongated lengths of each of said oxidizer modules, said burner module, and said pump room module being substantially equal to each other.

29. A method of disposing of hazardous waste material generated at an inland location, comprising the steps of loading said waste material in an intermodal shipping container substantially upon generation of said waste material at said inland location, transporting said intermodal shipping container to a dockside, loading said container aboard an oceangoing vessel, transporting said vessel to an offshore burnsite, feeding said waste material from said container to an incinerator at said offshore burnsite, and incineratng said waste material at said burnsite, said hazardous waste material remaining in said intermodal shipping container after loading therein until said feeding of the material to said incinerator.

30. A method according to claim 29, wherein said hazardous waste material is in substantially liquid form, and said intermodal shipping container is an intermodal tank shipping container.

* * * * *

UNITED STATES PATENT AND TRADEMARK OFFICE

CERTIFICATE OF CORRECTION

PATENT NO. : 4,552,082

DATED : November 12, 1985

INVENTOR(S) : VINCENT G. GREY

It is certified that error appears in the above-identified patent and that said Letters Patent is hereby corrected as shown below:

On the title page, in the list of references cited, Patent No. "4,099,667" (Tyer et al.) should be --4,009,667--.

Column 1, line 46, "Atsea" should be --At-sea--.

Column 4, line 21, "seagoing" should be --sea-going--.

Column 7, line 36, "nor" should be --not--.

Column 7, line 43, the numeral "3" should not be bold face.

Column 7, line 58, "Preferably . . ." should be the beginning of a new paragraph.

Column 8, line 19, "incinerator and extending" should be --incinerator oxidizers 27 and extending--.

Column 8, line 60, "on the vessel an incinerator" should be --on the vessel. An incinerator--.

Column 8, line 63, "(FIG. 22) and" should be --(FIG. 22), and--.

UNITED STATES PATENT AND TRADEMARK OFFICE

CERTIFICATE OF CORRECTION

PATENT NO. : 4,552,082

DATED : November 12, 1985

INVENTOR(S) : VINCENT G. GREY

It is certified that error appears in the above-identified patent and that said Letters Patent is hereby corrected as shown below:

Column 10, line 5, "13 and 14 are" should be --13 and 14, are--.

Column 13, line 21, "incin-erators" should be --incinerators--.

Signed and Sealed this

*Fourth* Day of *February 1986*

[SEAL]

*Attest:*

DONALD J. QUIGG

*Attesting Officer* *Commissioner of Patents and Trademarks*